US006321479B1

(12) United States Patent
Sheehan

(10) Patent No.: US 6,321,479 B1
(45) Date of Patent: Nov. 27, 2001

(54) APERTURE GUN SIGHTS

(76) Inventor: Timothy J. Sheehan, P.O. Box 20489, Sedona, AZ (US) 86341-0489

( * ) Notice: Subject to any disclaimer, the term of this patent is extended or adjusted under 35 U.S.C. 154(b) by 0 days.

(21) Appl. No.: 09/022,166

(22) Filed: Feb. 11, 1998

Related U.S. Application Data

(60) Provisional application No. 60/037,204, filed on Feb. 14, 1997, now abandoned.

(51) Int. Cl.[7] ..... F41G 1/02; F41G 1/08

(52) U.S. Cl. ..... 42/100; 33/241; 33/243; 33/261

(58) Field of Search ..... 42/100, 102; 33/241, 33/242, 243, 251, 253, 261

(56) References Cited

U.S. PATENT DOCUMENTS

| | | | | |
|---|---|---|---|---|
| 659,606 | * | 10/1900 | Formby | 33/261 |
| 846,217 | | 3/1907 | King, Jr. . | |
| 1,425,321 | | 8/1922 | Etherington . | |
| 2,488,836 | | 11/1949 | Sweetman | 33/241 |
| 2,645,017 | | 7/1953 | Hasse . | |
| 4,745,698 | * | 5/1988 | Schwulst | 42/100 |
| 4,850,113 | * | 7/1989 | Doll | 33/261 |
| 5,572,795 | * | 11/1996 | Kregloh | 33/251 |

FOREIGN PATENT DOCUMENTS

| | | | | |
|---|---|---|---|---|
| 50480 | * | 10/1911 | (AT) | 33/261 |
| 660787 | * | 4/1963 | (CA) | 33/257 |
| 11838 | | 8/1916 | (GB) . | |
| 380842 | * | 1/1931 | (GB) | 33/241 |

* cited by examiner

*Primary Examiner*—Stephen M. Johnson
(74) *Attorney, Agent, or Firm*—Eric J. Sheets

(57) ABSTRACT

The present invention is directed to a sighting device having an aperture with a series of visual reference points framing the aperture that are used in concert with a vertical front sight to quickly acquire and precisely aim a firearm at a target. The visual reference points framing the aperture are readily discernable to a shooter, even though the reference points and the aperture may be visually out of focus as the shooter concentrates on the target. The visual reference points framing the aperture are in the form of edges, angles, and vertices that take advantage of the human eye's natural acuity for angular geometric shapes as the shooter visually coordinates the position of the present invention with the vertical front sight and a target. The unobstructed field of view provided by the aperture portion of the present invention combined with readily discernable geometrically shaped visual reference points framing the aperture assist the shooter in precisely aiming a firearm, or other projectile propulsion device, at a target. In addition, rapid and accurate adjustments, or refinements, in the shooter's aim at a target are readily effected with the present invention.

30 Claims, 28 Drawing Sheets

APERTURE GUN SIGHTS

This application is based on U.S. provisional application Ser. No. 60/037,204, filed Feb. 14, 1997 now abandoned.

FIELD OF THE INVENTION

The present invention is directed to sighting devices and sighting systems used to assist in aiming various implements at a target, particularly hand-held implements, including firearms and the like.

BACKGROUND OF THE INVENTION

Since the advent of firearms and the like, superior shooting skills have been a key factor in the effective use of these devices. Such shooting skills usually combine visual acuity with dexterous handling of the firearm to accurately aim the firearm at a target. Accurate shooting is a process that usually starts with visual acquisition of a target. The process continues by aiming of a firearm at the target, often with a sighting device. Once the firearm is aimed at a target and a decision made to fire a projectile at the target, the firearm is actuated so that a projectile is released from the firearm at the target. In situations involving a moving target, accurate aiming of a firearm at the target requires a concerted effort to continuously adjust the firearm user's visual perception of the target while performing physical adjustments of the firearm to keep the firearm accurately aimed at the target.

Most firearms and other projectile propulsion devices are similar in that they enable a vectored propulsion force to be applied to a projectile in order to propel the projectile a distance in substantially the same direction as the applied vectored force. A variety of sighting devices have been developed to aid a shooter in making aiming adjustments of the firearm at a target. Generally speaking, there are two types of conventional sighting devices used with projectile propulsion devices. The first type is commonly known as a notch sight. The second type of sight is referred to as an aperture sight.

A notch sight is usually made of solid material with a notch, or three sided cut-out, centrally placed in the material such that a field of view can be seen through the notched portion of the sight when aiming a firearm with the sight. Most notch sights are placed on a rear portion of a firearm. These rear notch sights are most often used in combination with a vertical front sight placed near the front, or open end, of the firearm's barrel. Most vertical front sights take the form of a blade or a post. In use, the vertical front sight is visually placed in the field of view seen in the notched area of the sight so that the top of the front sight is even with the top of the notch sight. The target is visually positioned either partially behind or on top of the front sight. To aim straight ahead, the front sight is visually placed in the center of the field of view seen through the notched portion of the sight. To adjust the aim of the firearm for changing distance to the target, for windage, or movement of the target, for example, the firearm is moved in a direction appropriate to visually maintain the front sight within the field of view of the notch while keeping the target in close visual proximity to the top of the front sight.

The small field of view provided a shooter by a notch sight permits only minor adjustments in the aim of the firearm before the front sight becomes obscured by the bulk material adjacent to the notched portion of the sight. This limitation can cause several problems for the shooter. One problem is a difficulty in quickly acquiring a target when sighting through the notched portion of the sight. Another problem is the tendency of a shooter to lose sight of a moving target when viewing through the notched portion of the sight as the shooter leads the moving target. One of the most significant problems facing a shooter with a notch sight is an increased danger of failing to see an unintended target in an area in which the shooter is aiming.

Another limitation of notch sights is a dependence of the sights on lighting conditions. For example, in low light conditions it is often difficult to see a vertical front sight to visually align it with the notched portion of the rear notch sight. In angled light, such as from a street light or from sunlight at dusk or dawn, optical illusions can occur that cause the shooter's eye to misperceive the precise position of the front sight relative to the notch or to misperceive the position of the target itself. The limited field of view provided by the rear notch sight compounds the difficulty in seeing such a visually altered front sight.

Aperture sights provide a shooter with a wider field of view through the sight than notch sights. Despite a greater field of view through aperture sights, aiming refinements are usually more difficult with aperture sights than with notch sights. A conventional aperture sight is a circular ring or tube mounted atop a firearm barrel near the rear end of the barrel.

One of the initial uses of aperture sights was to hunt dangerous game. An aperture sight is particularly suited for this task by providing an unobstructed opening through which a shooter can easily survey terrain for stationary or moving targets while viewing through the sight. Once a target is identified, the aperture sight enables the shooter to continue to view the target through the sight and grossly adjust the aim of the firearm at the target. Since the aperture does not obscure a target at close range and because the size and proximity of the target usually does not require a high degree of aiming refinement, the aperture sight is particularly suited for facing charging game.

In many uses, the circular rear aperture sight is visually aligned with another circular aperture sight positioned atop the barrel toward the front, or open, end of the barrel. When a user looks through both sights together, the visual impression is one in which the rear aperture sight appears larger than the front aperture sight. In general, as the firearm is aimed directly at a target at medium range, the target appears to be located in the center of the front aperture sight with the front aperture sight in turn appearing to fit concentrically within the rear aperture sight.

One attempt to provide a means to align a front aperture sight with a rear aperture sight is disclosed in U.S. Pat. No. 4,745,698, issued to Schwulst. In this disclosure, the front sight has light emitting diodes, or other low light source, placed around the circumference of the aperture portion of the front sight. The light source faces toward the rear of the firearm and into the shooter's eye. In order to aim at a target directly in front of the firearm, the ring of luminous dots formed by the light emitting diodes on the front aperture sight is visually positioned within and partially obscured by the circumference of the aperture portion of the rear aperture sight. Once these apertures are aligned with respect to one another, the shooter visually positions a target in the center of the apertures to aim a firearm at the target.

The Schwulst sights and other aperture sights highlight the central problem with conventional aperture sights, namely the inability of these sights to readily provide the shooter with means to make rapid and accurate visual aiming adjustments to targets that are not positioned visually in the center of the aperture portion of the sight. This limitation is particularly evident if the shooter is required to compensate for changing distance to the target, windage, or motion of the target that visually places the target away from the center area of the aperture.

Accurate aiming of a firearm with some conventional circular aperture sights has been improved somewhat when the sight is used with a conventional vertical front sight. In use, the top of the vertical front sight assists the shooter in visually locating the central region of the aperture portion of the sight. The front sight is then used to visually place the target on top of the front sight in the central region of the aperture portion of the sight. Even with the aid of a vertical front sight, a circular aperture sight does not provide a shooter with visual reference points that permit rapid and precise aiming refinements at a target, particularly when the target is visually positioned away from the central portion of the aperture.

A rear aperture sighting device having visual reference points in the form of straight edges, angles, and vertices framing the aperture portion of the sighting device would provide a user with means to more effectively utilize a vertical front sight to perform rapid and accurate target acquisition and aiming refinements, particularly with targets that are not visually positioned in the center of the aperture.

SUMMARY OF THE INVENTION

The present invention is directed to a sighting device having an aperture with a series of geometrically shaped visual reference points framing the aperture. The visual reference points are used in concert with a vertical front sight to quickly acquire and precisely aim a firearm and the like at a target. The visual reference points framing the aperture are readily discernable to a shooter, even though the reference points and the aperture may be visually out of focus as the shooter concentrates on the target. The visual reference points framing the aperture are in the form of edges, angles, and/or vertices that take advantage of the human eye's natural acuity for lines and angular geometric shapes. The unobstructed field of view provided by the aperture portion of the present invention combined with the readily discernable geometrically shaped visual reference points framing the aperture assist the shooter in coordinating the position of the present invention with a vertical front sight and a target in order to precisely aim a projectile propulsion device at the target. In addition, rapid and accurate adjustments in the shooter's aim at a target are readily performed with the present invention, particularly with targets that are not visually positioned in the central region of the aperture. The present invention is primarily intended for use with projectile propulsion devices, such as firearms, cross-bows, and non-lethal weapons, such as rubber-bullet guns, bean-bag guns, and tear-gas guns. The present invention is particularly suited for aiming such devices at targets that are subject to movement, windage, or elevation variations.

Accordingly, in one embodiment, the present invention is a rear aperture sight for use in combination with a vertical front sight, said aperture sight comprising a solid material having a hole therein through which light can pass, at least a portion of said hole having a perimeter with a shape in the form of a polygon, said polygon-shaped perimeter comprising a series of straight edges with ends thereof connected to form a series of vertices, wherein said straight edges and vertices are adapted to serve as visual reference points, wherein said visual reference points assist a user to visually align a vertical front sight with a target, and wherein said solid material further comprises a base portion that is adapted to attach to a device that propels projectiles.

The present invention is also directed to a sighting system that employs a rear aperture sight having visual reference points framing the aperture in combination with a vertical front sight having a top portion that incorporates one or more visual reference points therein. A preferred cross-sectional shape for the visual reference points is a hexagon cut in half through opposite vertices to form a "hemis-hexagon" shape (see FIG. 27A, for example).

A particular benefit of sighting aids of the present invention is the aiming assistance provided to users who have the visual disability known as hypermetropia (farsightedness). Hypermetropia is one of the most common visual disabilities encountered by humans as they advance in years. This benefit is particularly evident when comparing the present invention to conventional rear notch sights and even more so when compared to conventional aperture sights.

Other features and advantages of the present inventions will become apparent upon review of the following specification, drawings, and claims.

BRIEF DESCRIPTION OF THE DRAWINGS

FIG. 27A illustrates an enlargement of the front sight of FIG. 27. The front sight has a groove cut in the top of the sight along the longitudinal axis of the projectile propulsion device having a cross-sectional shape of a hemis-hexagon.

Figure 1A:
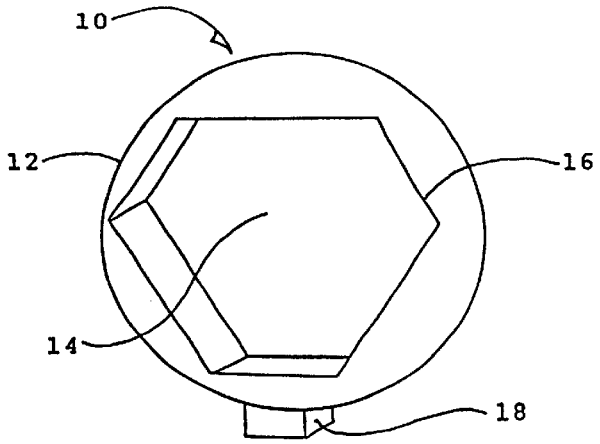
FIG. 1*a* illustrates an embodiment of the present invention (10), wherein material (12) defines an aperture portion (14) that has a cross-section in the shape of an irregular polygon (16) and a base portion (18).
Figure 2A:
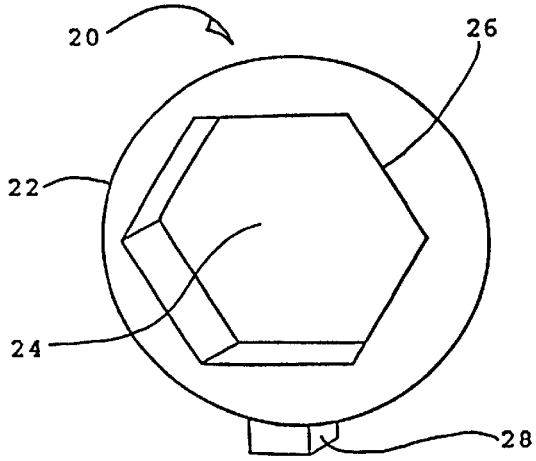
FIG. 2*a* illustrates an embodiment of the present invention (20), wherein material (22) defines an aperture portion (24) that has a cross-section in the shape of a regular polygon (26) and a base portion (28).
Figure 3A:
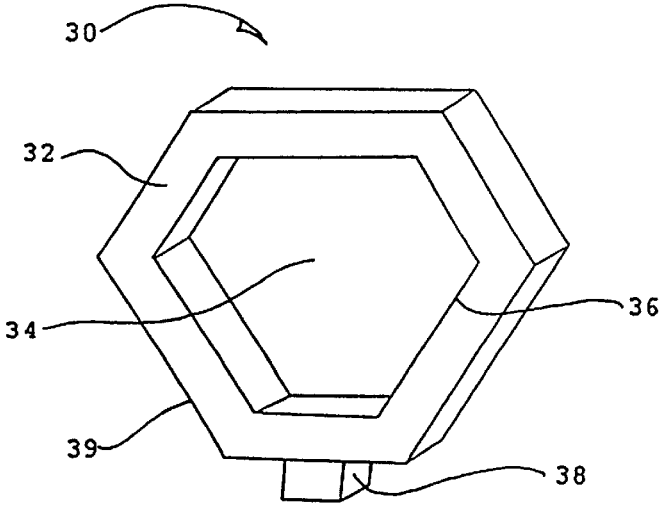
FIG. 3*a* illustrates an embodiment of the present invention(30), wherein material (32) defines an aperture portion (34) that has a cross-section in the shape of an irregular polygon (36) and an outer perimeter portion in the shape of an irregular polygon (39) and a base portion(38).
Figure 4A:
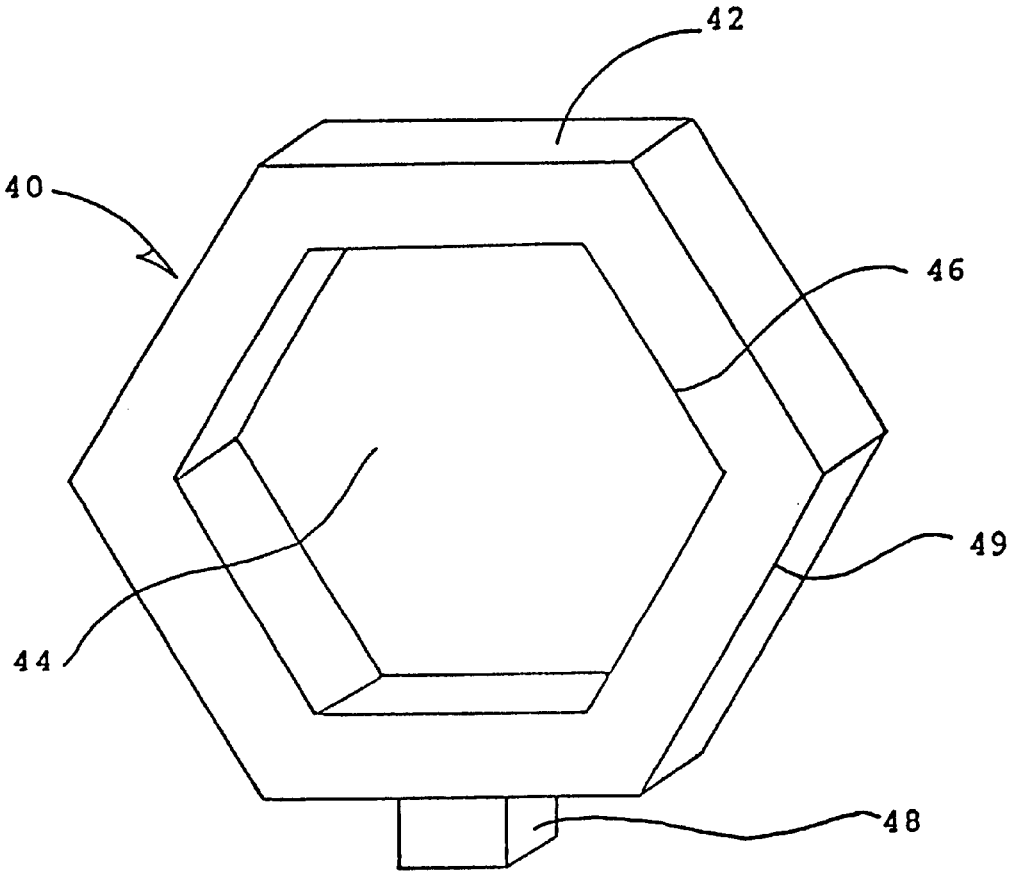
FIG. 4*a* illustrates an embodiment of the present invention (40), wherein material (42) defines an aperture portion (44) that has a cross-section in the shape of a regular polygon (46) and an outer perimeter portion in the shape of a regular polygon (49) and a base portion (48).
Figure 5A:
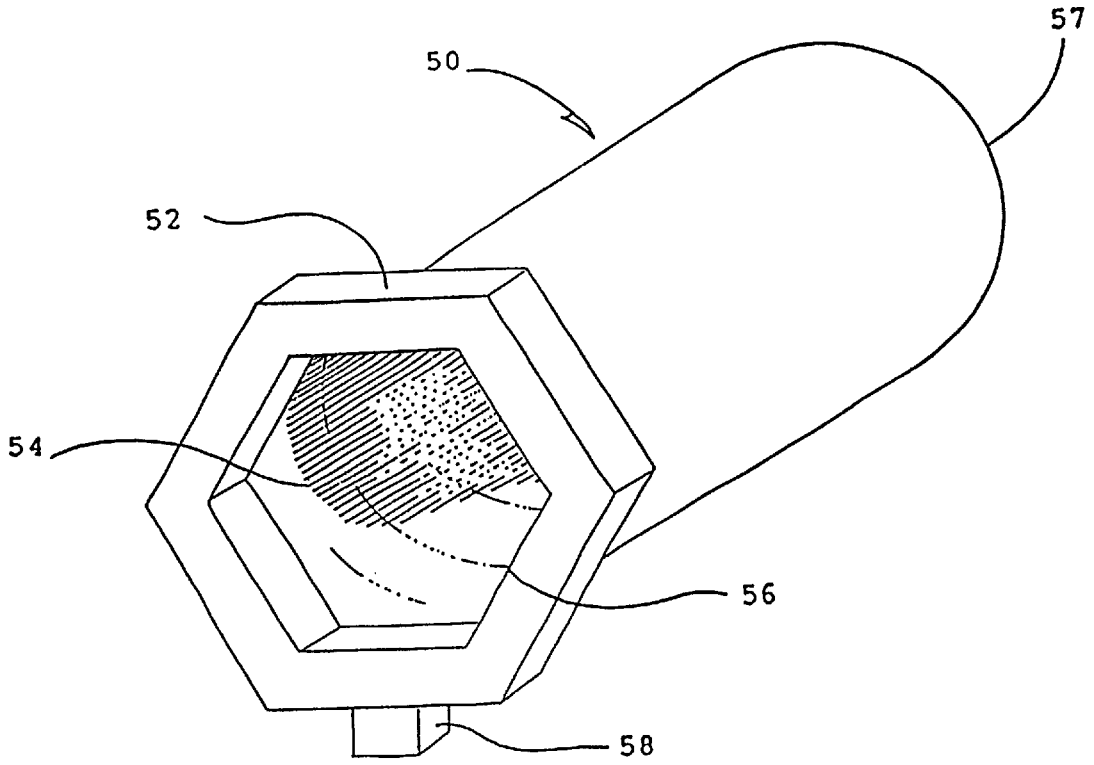
FIG. 5*a* illustrates an embodiment of the present invention (50), wherein material (52) defines an aperture portion (54) that has a cross-sectional shape of a polygon (56) with additional material (57) that defines a remaining portion and a base portion (58).
Figure 6A:
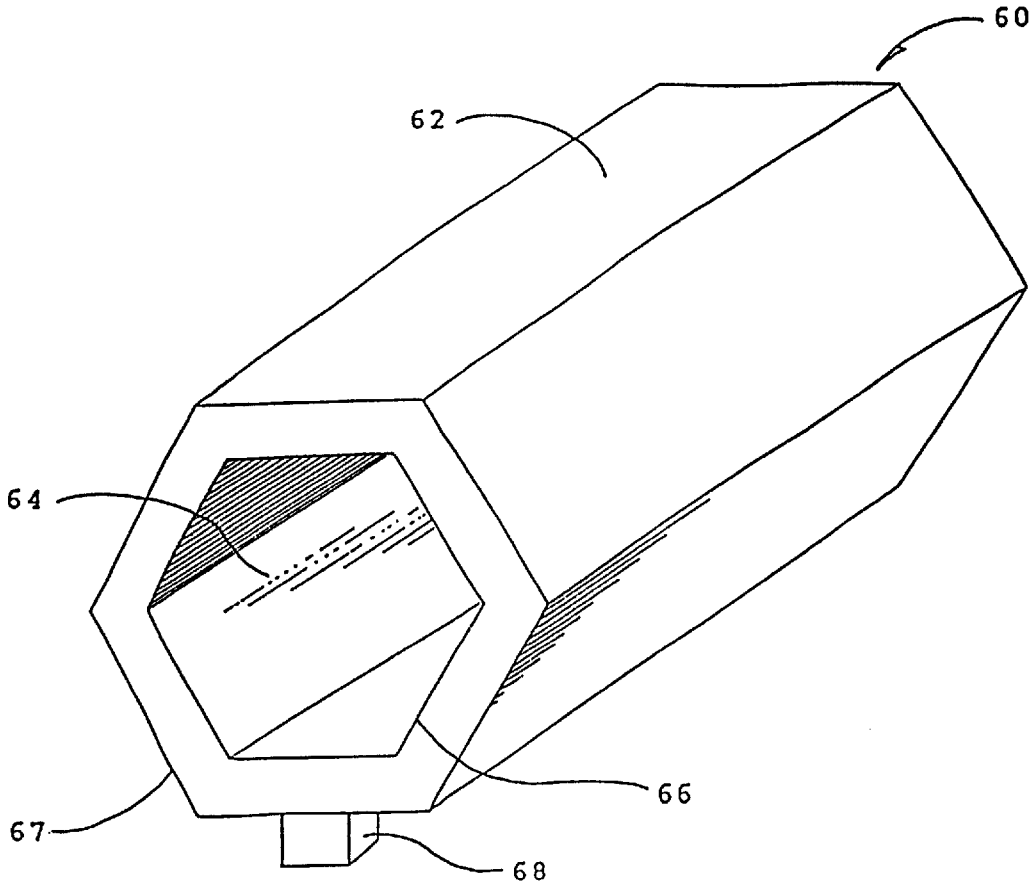
FIG. 6*a* illustrates an embodiment of the present invention (60), wherein material (62) is in the form of a hollow prism that defines an aperture portion (64) having a cross-section in the shape of a polygon (66) and an outer perimeter portion in the shape of a polygon (67) and a base portion (68).
Figure 7A:
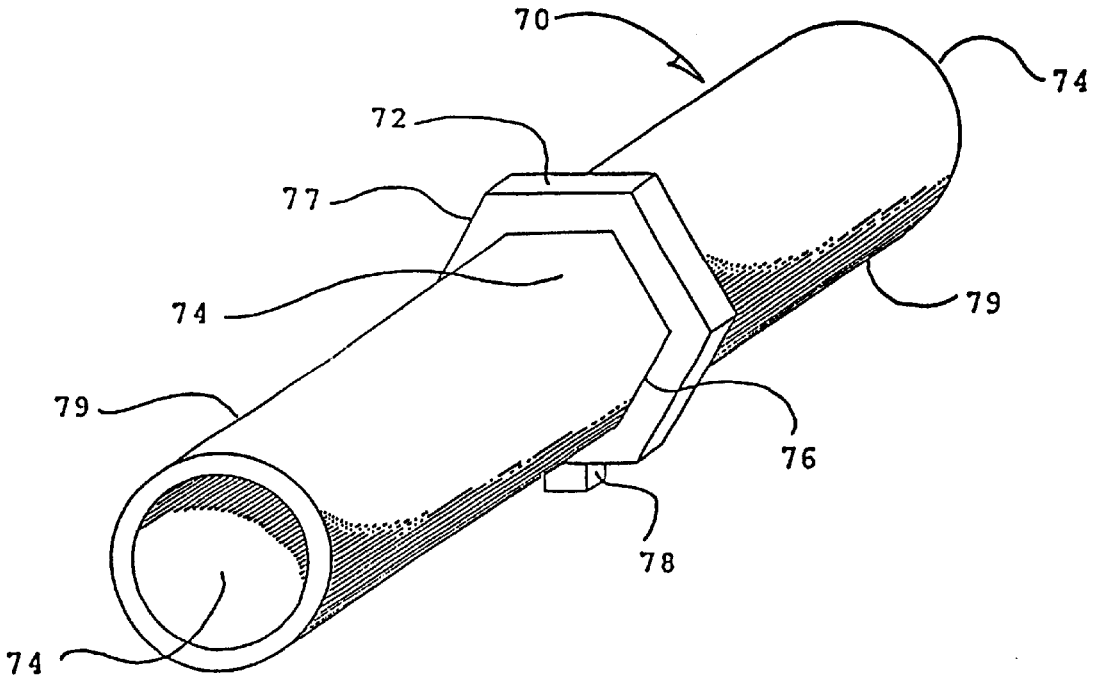
FIG. 7*a* illustrates an embodiment of the present invention (70), wherein material (72) has a first portion that defines an aperture portion (74) having a cross-section in the shape of a polygon (76) and an outer perimeter portion in the shape of a polygon (77) and additional remaining portions (79) on both sides of the first portion and a base portion (78).
Figure 8A:
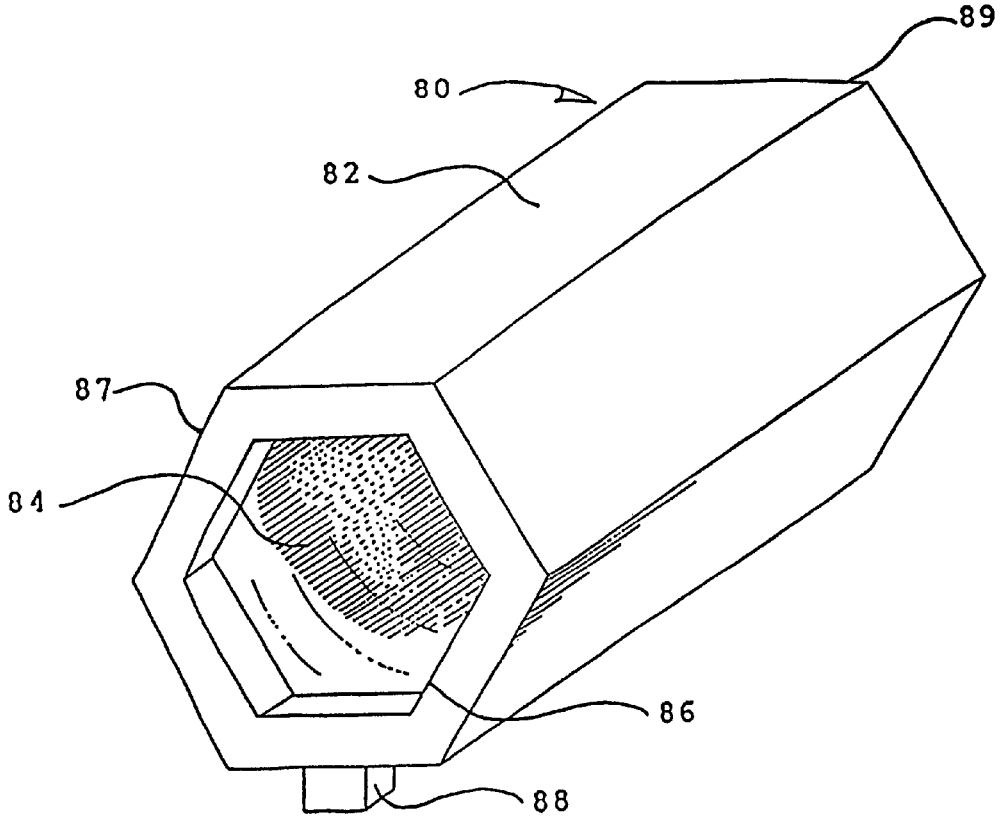
FIG. 8*a* illustrates an embodiment of the present invention (80), wherein material (82) has a first portion that defines an aperture portion (84) having a cross-section in the shape of a polygon (86) and an outer perimeter portion in the shape of a polygon (87) and a second remaining portion (89) and a base portion (88).
Figure 9A:
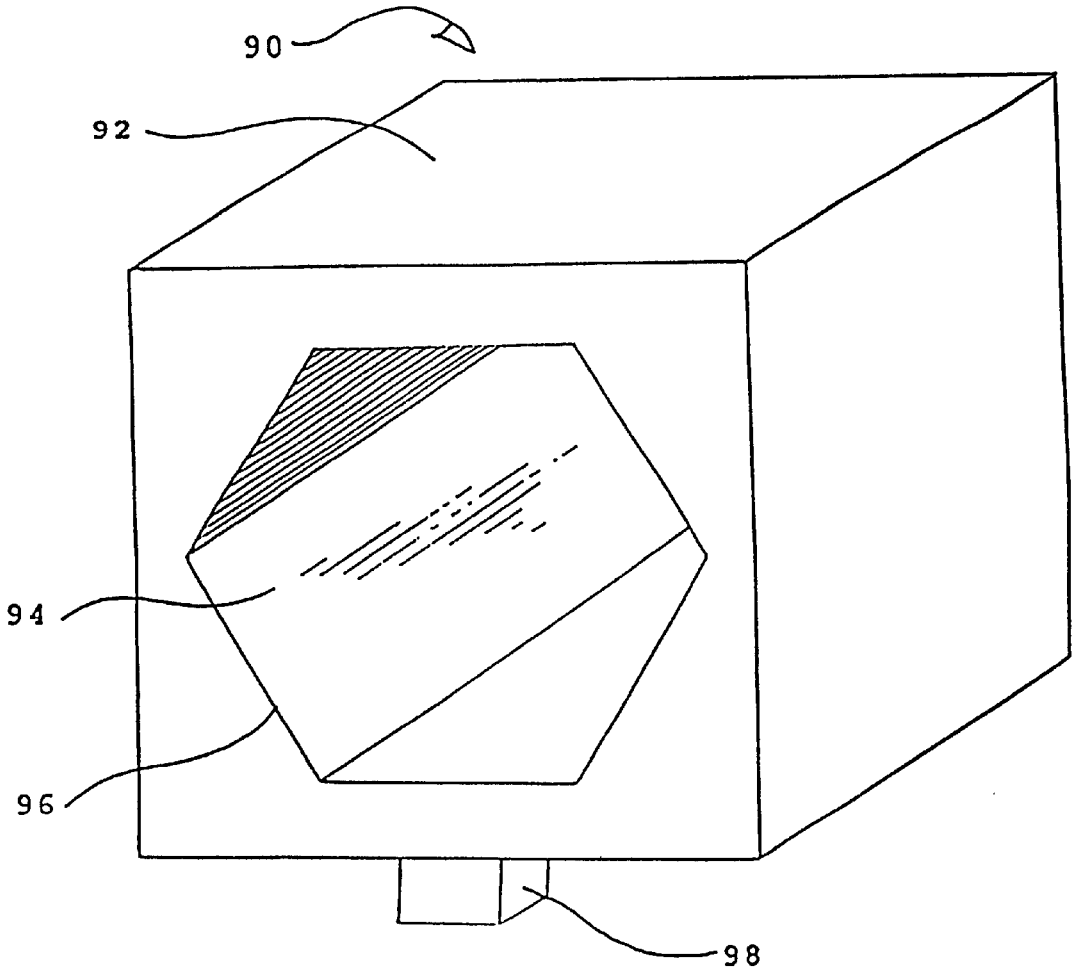
FIG. 9*a* illustrates an embodiment of the present invention (90), wherein material (92) has a portion that defines an aperture (94) having a cross-section in the shape of a polygon (96) and a base portion (98).
Figure 10A:
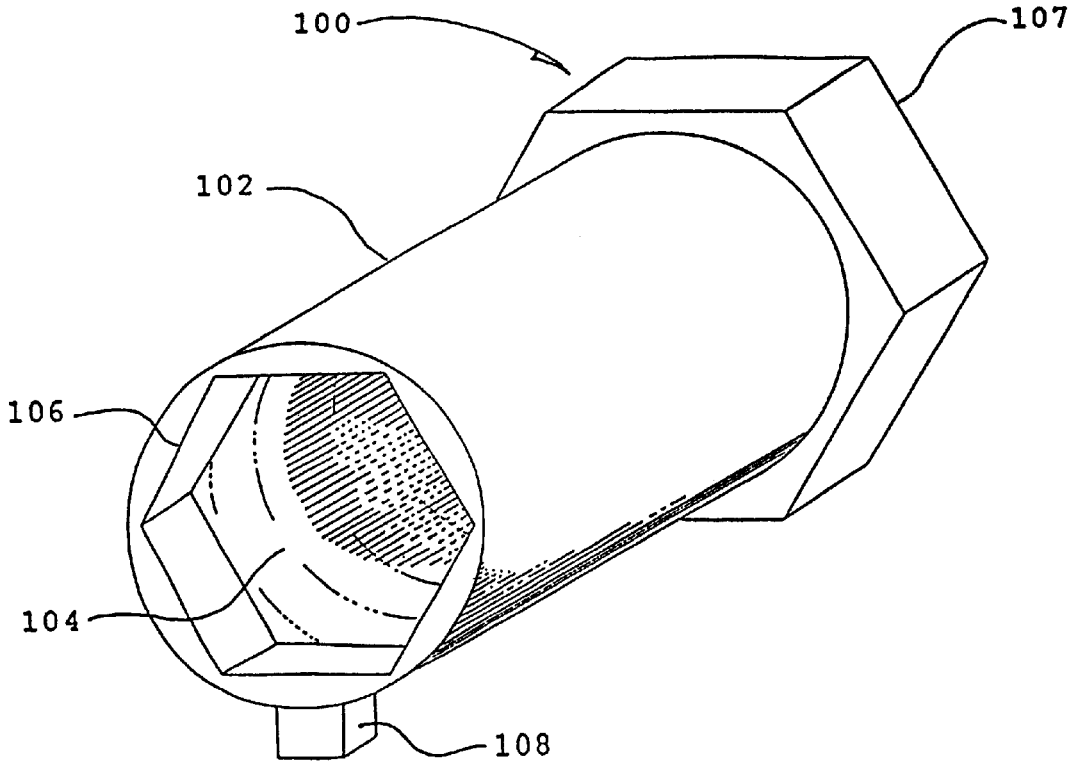
FIG. 10*a* illustrates an embodiment of the present invention (100), wherein material (102) has a first portion that defines an aperture portion (104) having a cross-section in the shape of a polygon (106) and a second portion having an outer perimeter portion in the shape of a polygon (107) and a base portion (108).
Figure 11:
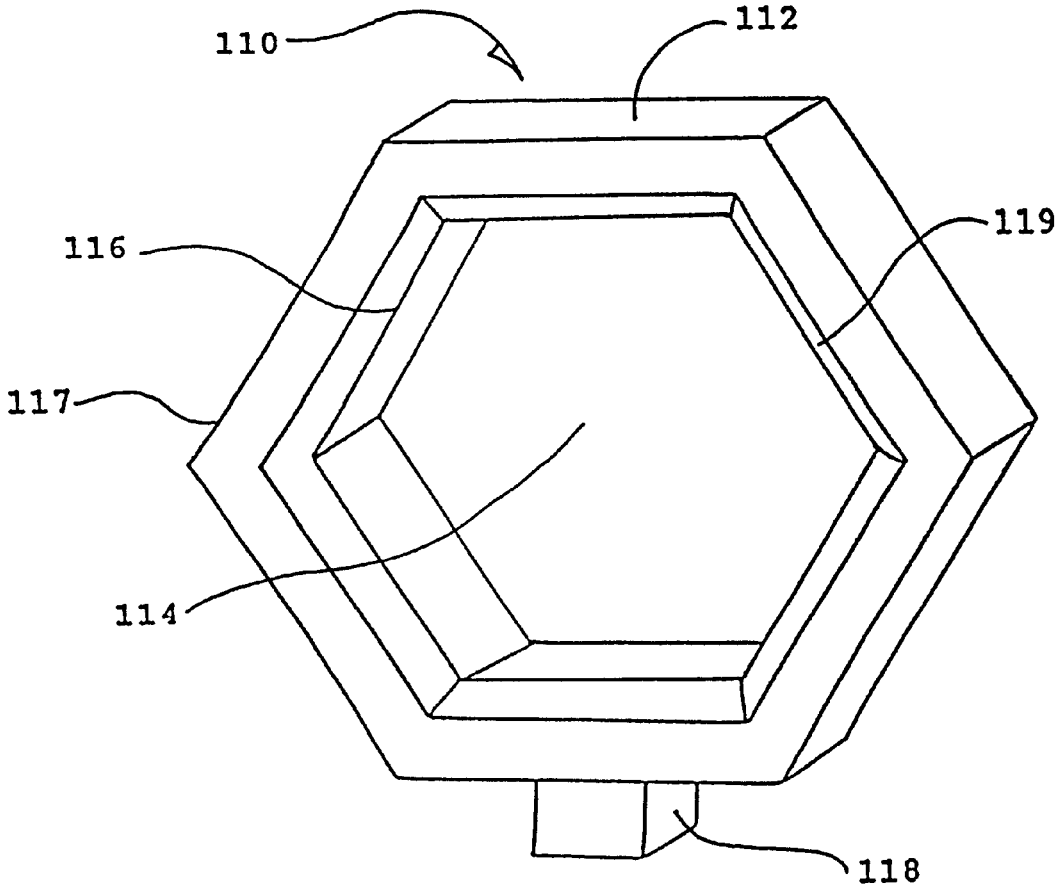
FIG. 11 illustrates a preferred embodiment of the present invention (110), wherein material (112) defines an aperture portion (114) that has a cross-section in the shape of a polygon (116) and an outer perimeter portion in the shape of a polygon (117), wherein both polygonal shapes are congruent, and wherein material adjacent to the aperture is removed to form a cavity (119) and a base portion (118).
Figure 12:
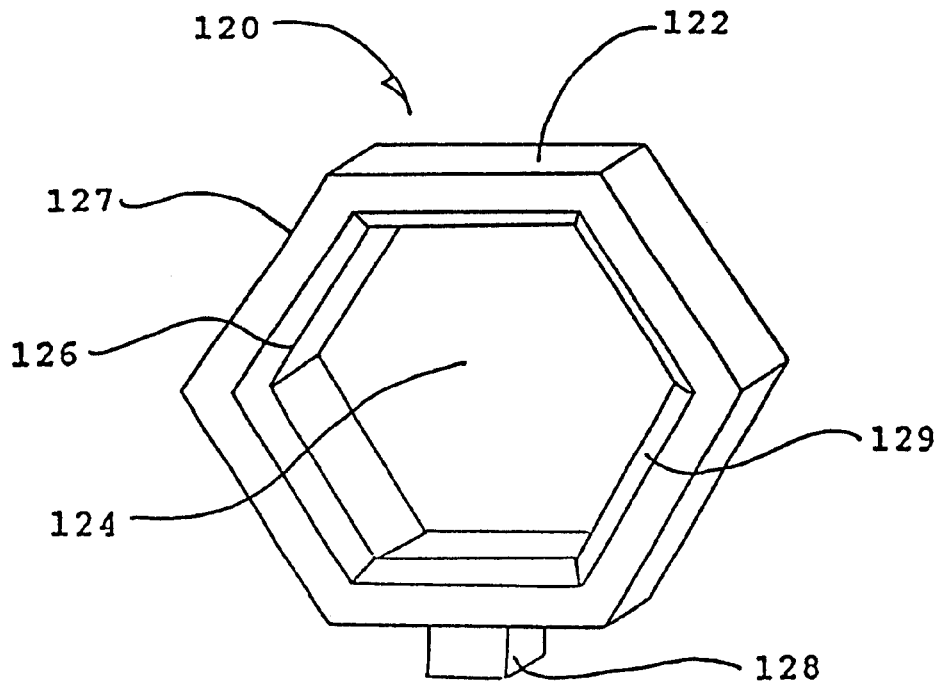
FIG. 12 illustrates an embodiment of the present invention (120), wherein material (122) defines an aperture portion (124) that has a cross-section in the shape of a polygon (126) and an outer perimeter portion in the shape of a polygon (127), and wherein material adjacent to the aperture (129) is surface modified or painted and a base portion (128).
Figure 13:
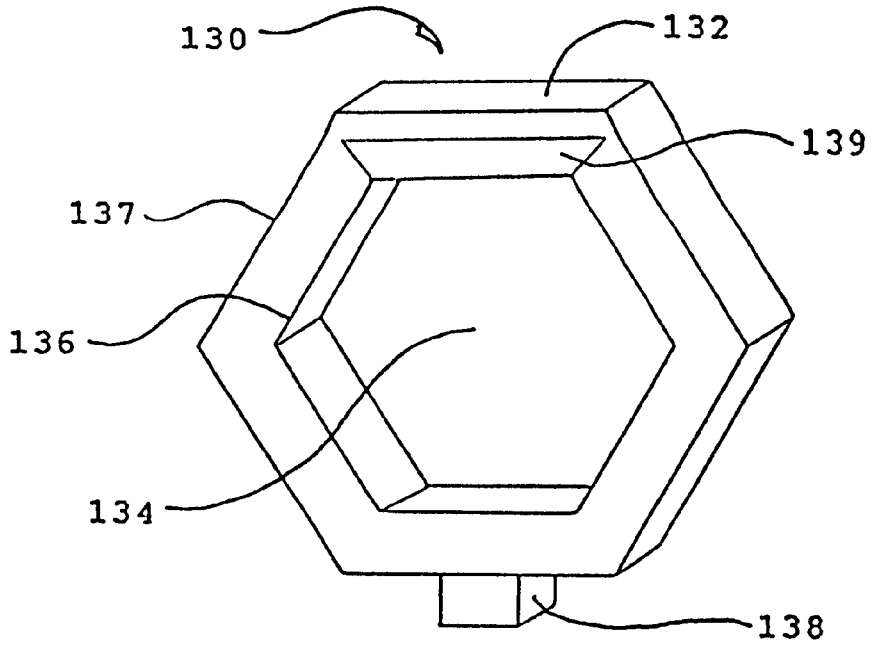
FIG. 13 illustrates an embodiment of the present invention (130), wherein material (132) defines an aperture portion (134) that has a cross-section in the shape of a polygon (136) and an outer perimeter portion in the shape of a polygon (137), and wherein a portion of the material adjacent to the aperture (139) is removed, surface modified, or painted and a base portion (138).

It is understood that polygonal shapes other than those illustrated in above-described Figures may find utility in the present invention. These shapes include, but are not limited to, triangles, squares, rectangles, pentagons, hexagons, heptagons, octagons, decagons, and dodecagons, etc. Furthermore, the features of one Figure are not limited to the particular Figure. The various features illustrated in the Figures can be interchanged among the Figures.

Before explaining the preferred embodiments, it is to be understood that the inventions are not limited in use to the details of construction or methodologies there set forth or as illustrated in the drawings. The inventions are capable of other embodiments and of being practiced and carried out in various ways.

DETAILED DESCRIPTION OF THE INVENTION

The present invention is directed to a sighting aid for an implement requiring visual aiming. One sighting aid of the present invention is a rear aperture sight through which light can travel. At least a portion of the aperture has a perimeter with a cross-sectional shape that delimits the shape of a polygon. The polygon is a closed plane figure bounded by three or more edges, or line segments. The preferred cross-sectional shape of the polygon-shaped aperture is a hexagon. Angles are formed where the edges of the polygon-shaped aperture join along the perimeter of the aperture. Each of these angles has a vertex. The edges, angles, and/or vertices in the polygon-shaped aperture portion of the present invention are adapted to serve as visual reference points in the invention. The visual reference points are used in combination with a vertical front sight to aim the implement at a target.

For purposes of illustration, the polygonal shapes of the various portions of the present invention can be superimposed on a Cartesian coordinate system to assist in discussing the invention. In the system, the x-axis is regarded as being substantially perpendicular to the center of the earth, or substantially parallel to a plane conventionally referred to as the horizontal. For example, a polygon can have its center placed at the 0,0 position of the x-axis and the y-axis, respectively. Imaginary lines can then be drawn from the center of the polygon to each of the vertices of the polygon. Each of these lines will be at a particular angle on the Cartesian coordinate system. With a hexagon placed on such a grid, for example, each of the six vertices could be positioned at 0°, 60°, 120°, 180°, 240°, and 300°, respectively (see FIG. 30, for example).

Figure 19:
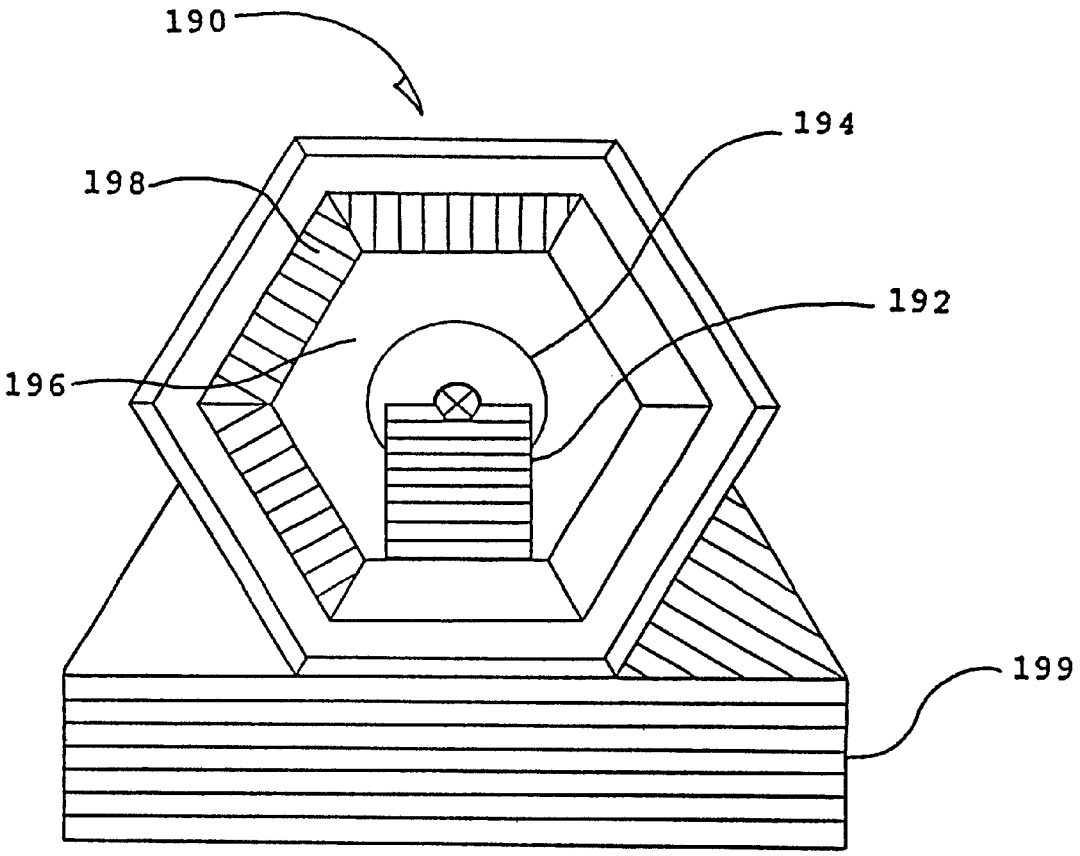
FIG. 19 illustrates an embodiment of the present invention (190) as seen from a user's point of view. Included in the Figure is a representation of a front sight (192) in the focus of the user's eye, a target (194), a polygonal shaped aperture portion (196), a cavity or shaded portion(198), and a base portion (199). The target in this Figure requires essentially no adjustment for elevation or windage.
Figure 21:
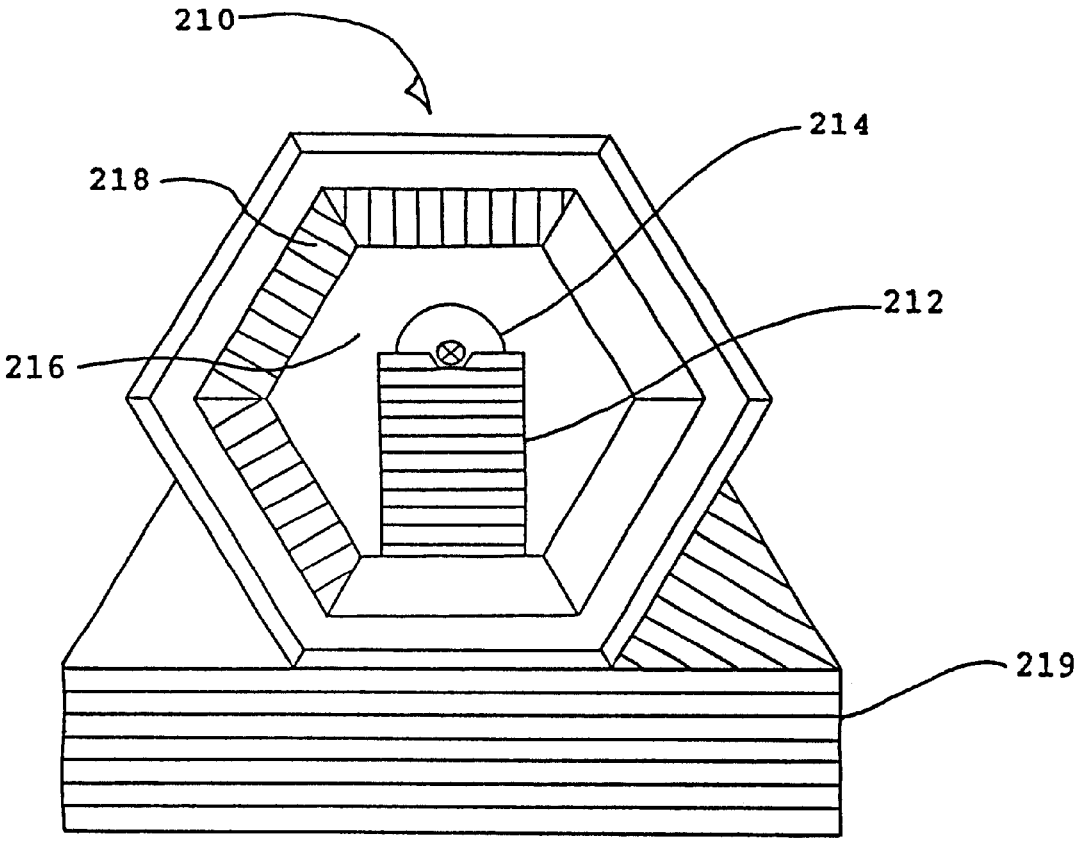
FIG. 21 illustrates an embodiment of the present invention (210) as seen from a user's point of view. Included in the Figure is a representation of a front sight (212) in the focus of the user's eye, a target (214), a polygonal shaped aperture portion (216), a cavity or shaded portion(218), and a base portion (219). The target in this Figure requires essentially no adjustment for windage. The target does require aiming refinement of the front sight visually positioned above the visual reference points of the aperture portion for the effects of elevation.
Figure 22:
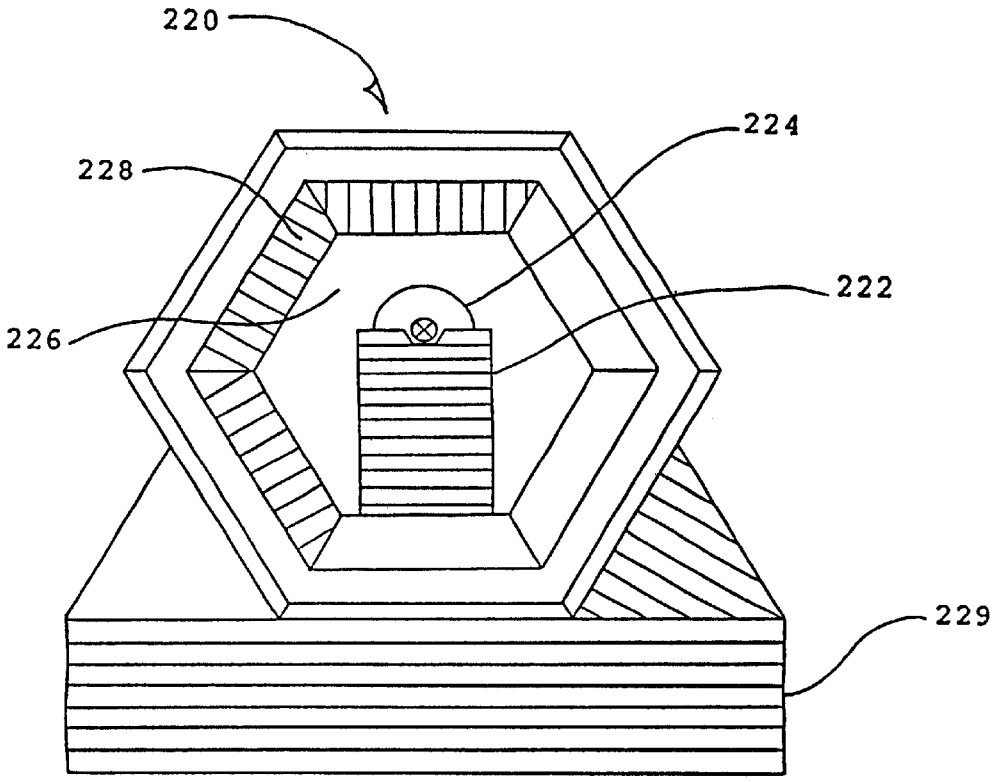
FIG. 22 illustrates an embodiment of the present invention (220) as seen from a user's point of view. Included in the Figure is a representation of a front sight (222) not in the focus of the user's eye, a target (224), a polygonal shaped aperture portion (226), a cavity or shaded portion(228), and a base portion (229). The target in this Figure requires essentially no adjustment for windage. The target does require aiming refinement of the front sight visually positioned above the visual reference points of the aperture portion for the effects of elevation.
Figure 23:
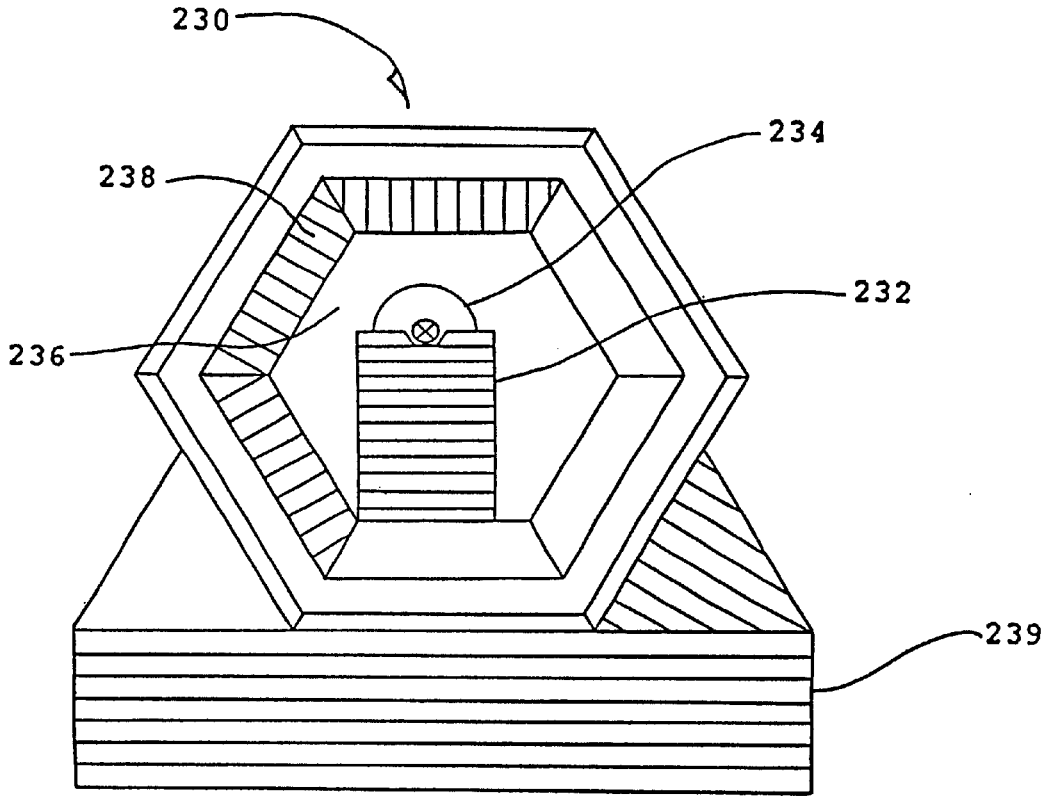
FIG. 23 illustrates an embodiment of the present invention (230) as seen from a user's point of view. Included in the Figure is a representation of a front sight (232) in the focus of the user's eye, a target (234), a polygonal shaped aperture portion (236), a cavity or shaded portion(238), and a base portion (239). The target in this Figure requires aiming refinement of the front sight visually positioned above the visual reference points and to the left of center of the aperture portion for the effects of elevation and windage, respectively.
Figure 30:
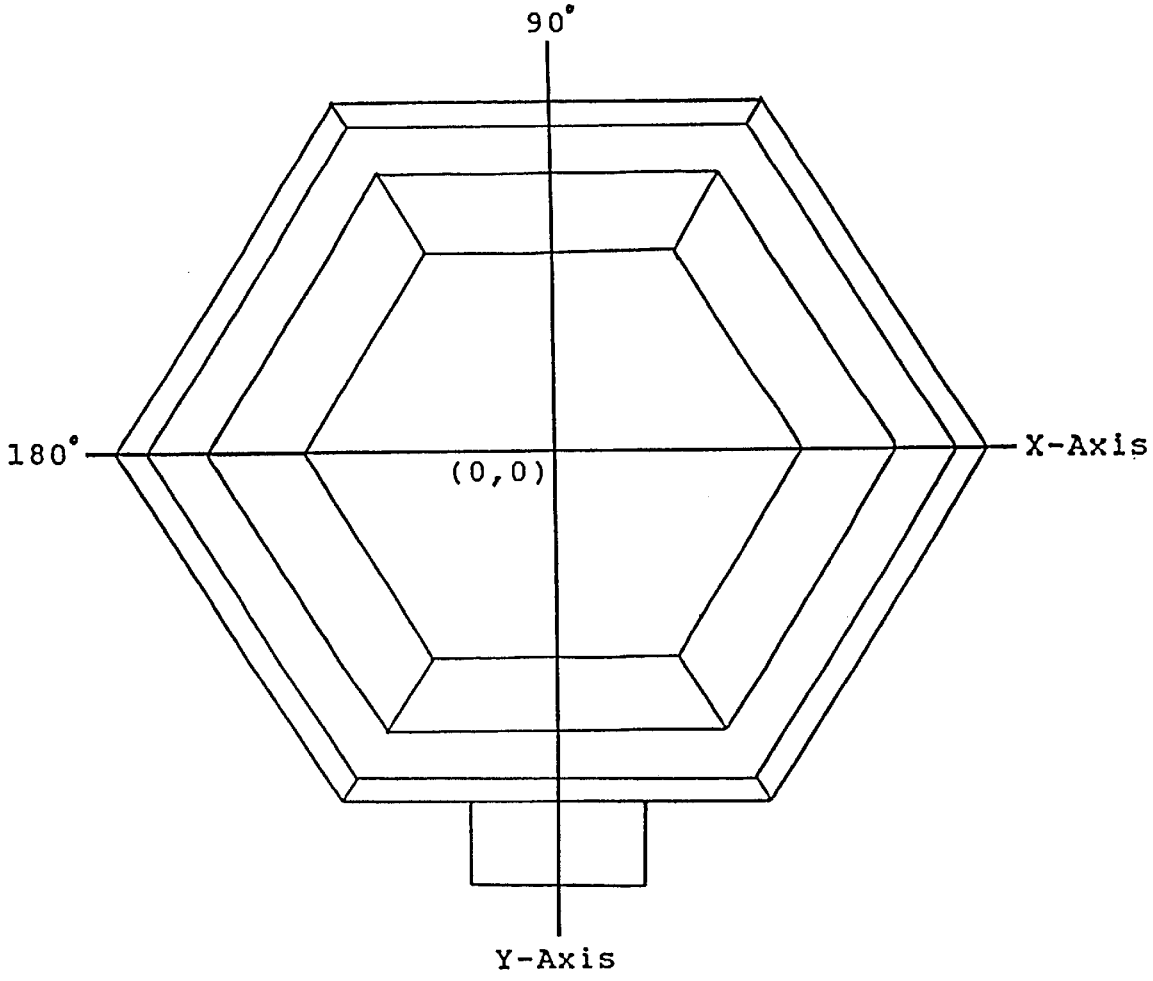
FIG. 30 illustrates a Cartesian coordinate system having a polygonal aperture portion of the present invention superimposed thereon.

In the preferred embodiment of the present invention, the hexagon shape of the aperture is oriented such that two of the vertices of the hexagon are located essentially at 0° and 180°, respectively (see FIG. 30). When these vertices are used as visual reference points, a shooter can envision an imaginary horizontal straight line connecting the vertices when viewing through the aperture. This horizontal imaginary line can be aligned with a front sight and/or a target (see FIGS. 19 and 22, for example). This type of alignment produces a "dead zero" elevation. For so called "non-zero" (Kentucky windage) aiming adjustments, the horizontal imaginary line assists the user in elevating the top of the front sight above the imaginary line to adjust the trajectory of the projectile for a longer range target (see FIGS. 21–23, for example). These and other edges, vertices, and/or angles of the polygonal shapes of the present invention afford a shooter with a variety of visual reference points to assist the shooter in aiming a projectile propulsion device at a target.

Figure 20:
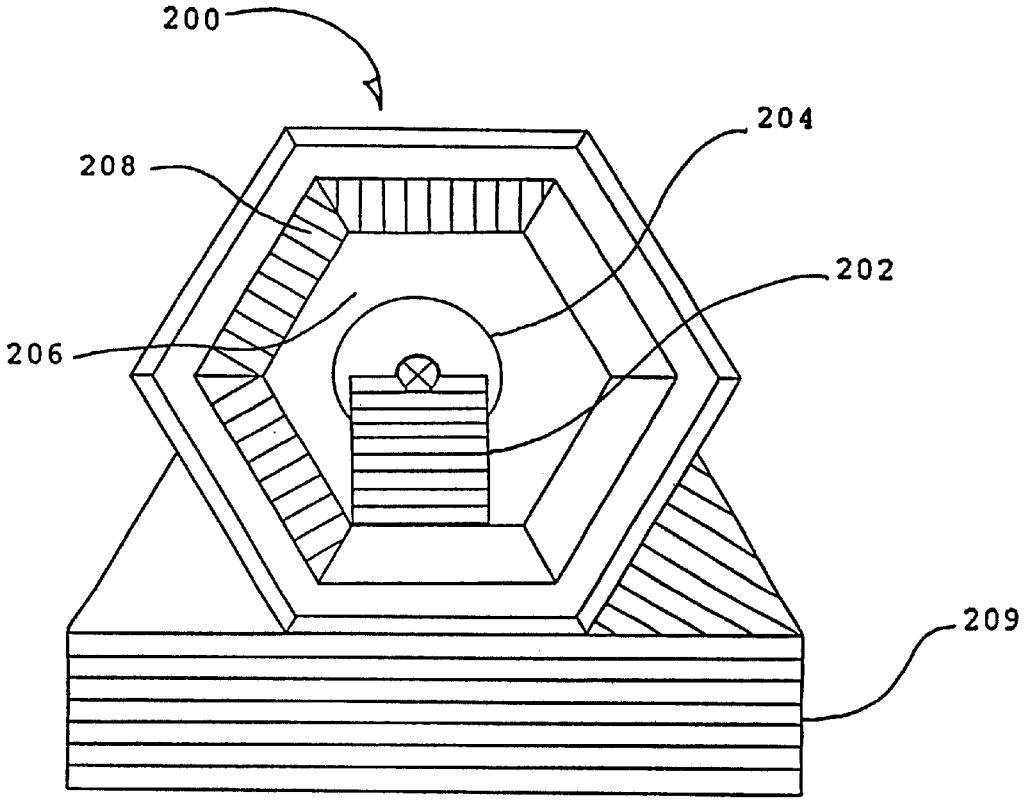
FIG. 20 illustrates an embodiment of the present invention (200) as seen from a user's point of view. Included in the Figure is a representation of a front sight (202) in the focus of the user's eye, a target (204), a polygonal shaped aperture portion (206), a cavity or shaded portion(208), and a base portion (209). The target in this Figure requires essentially no adjustment for elevation. The target does require aiming refinement of the front sight visually positioned to the left of center of the aperture portion for the effects of windage.

The visual reference points at 240° and 300° on a Cartesian coordinate system (see FIG. 30) are often used to visually reference the sides of a vertical front sight comprised of a blade or post. These visual reference points in combination with a vertical front sight are often used to assist a user to compensate for windage conditions (see FIG. 20, for example).

Figure 24:
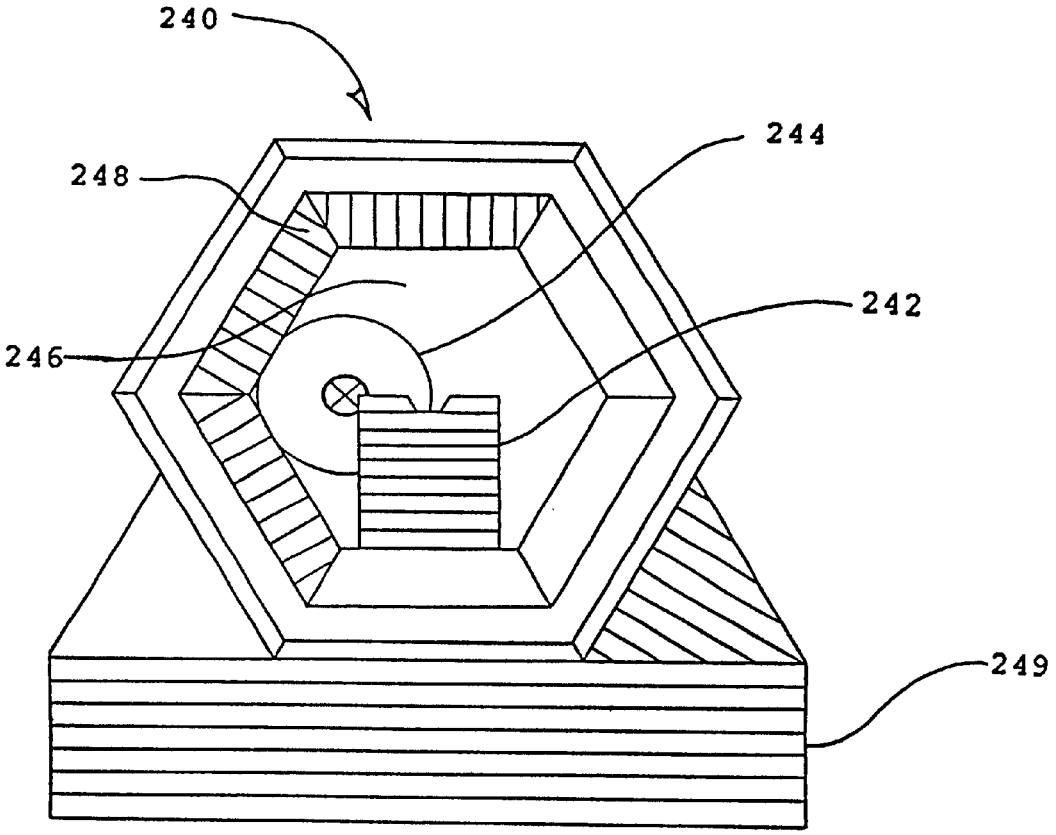
FIG. 24 illustrates an embodiment of the present invention (240) as seen from a user's point of view. Included in the Figure is a representation of a front sight (242) in the focus of the user's eye, a target (244), a polygonal shaped aperture portion (246), a cavity or shaded portion(248), and a base portion (249). The target in this Figure represents a moving target. Accordingly, the target requires aiming refinement of the front sight visually positioned in the central area of the aperture portion to properly compensate for the movement of the target to the right of the user.
Figure 25:
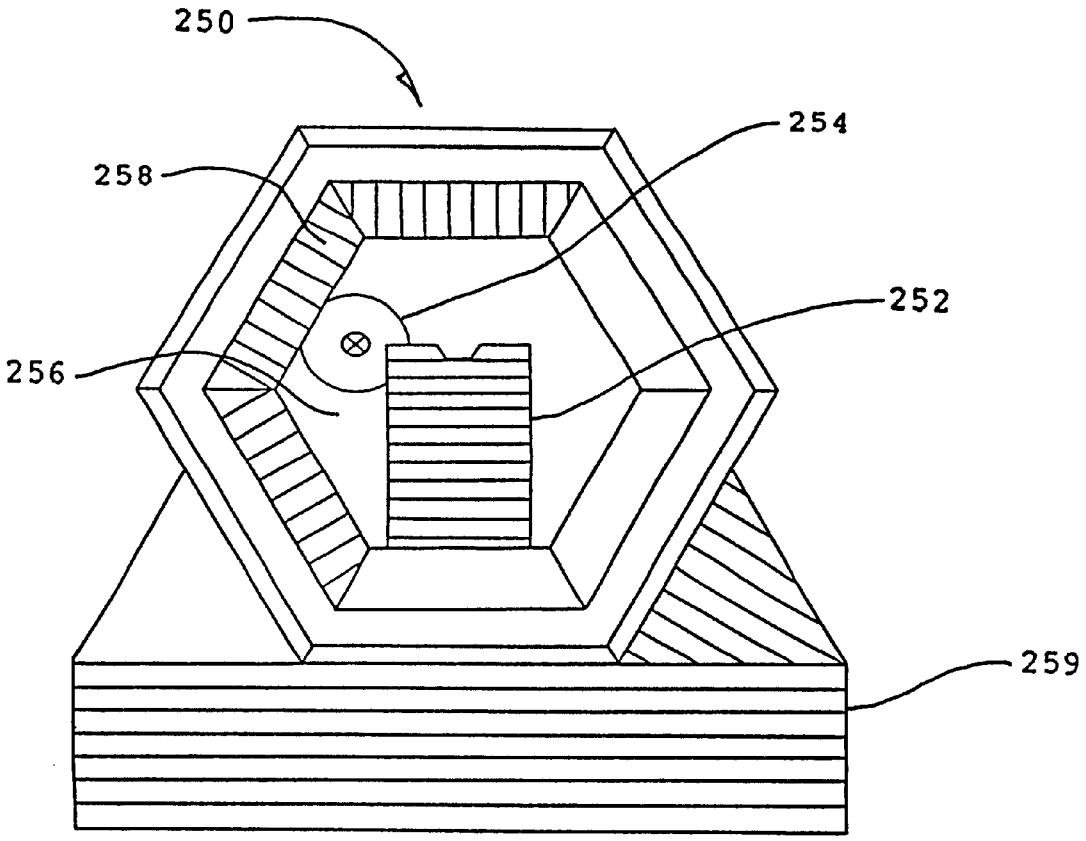
FIG. 25 illustrates an embodiment of the present invention (250) as seen from a user's point of view. Included in the Figure is a representation of a front sight (252) in the focus of the user's eye, a target (254), a polygonal shaped aperture portion (256), a cavity or shaded portion(258), and a base portion (259). The target in this Figure requires essentially no adjustment for windage. The target does require aiming refinement of the front sight visually positioned above the visual reference points of the aperture portion for the effects of elevation. In addition, the target in this Figure represents a moving target. Accordingly, the target requires aiming refinement of the front sight visually positioned in the central area of the aperture portion to properly compensate for the movement of the target to the right of the user.
Figure 26A:
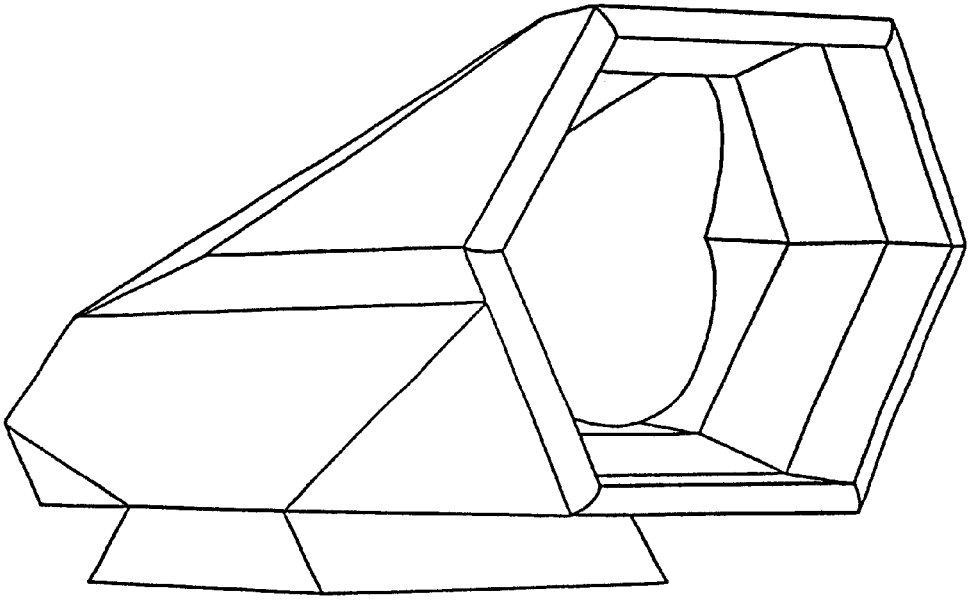
FIG. 26*a* illustrates a perspective view of a preferred embodiment of the present invention.
Figure 26B:
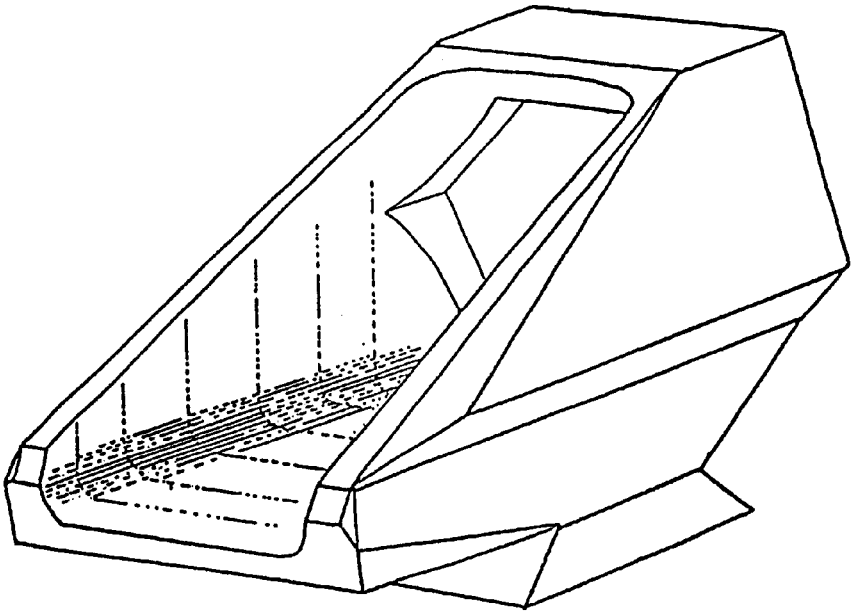
FIG. 26*b* illustrates a perspective view of a preferred embodiment of the present invention.
Figure 26C:
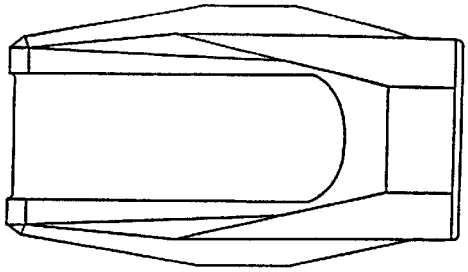
FIG. 26*c* illustrates a top view of a preferred embodiment of the present invention.
Figure 26D:
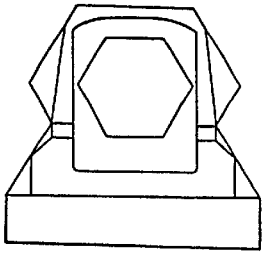
FIG. 26*d* illustrates a front view of a preferred embodiment of the present invention.
Figure 26E:
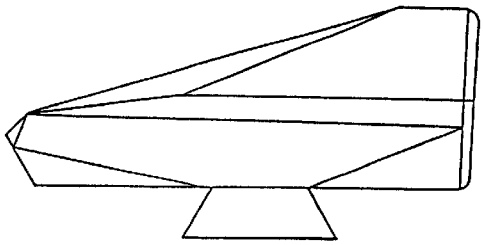
FIG. 26*e* illustrates a side view of a preferred embodiment of the present invention.
Figure 26F:
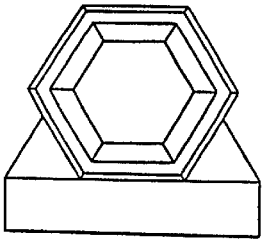
FIG. 26*f* illustrates a rear view of a preferred embodiment of the present invention.
Figure 26G:
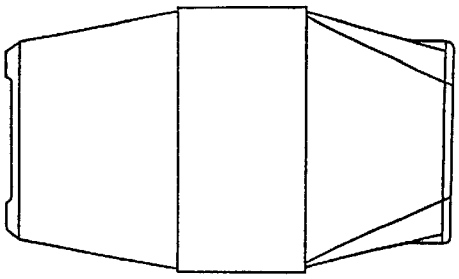
FIG. 26*g* illustrates a bottom view of a preferred embodiment of the present invention.
Figure 27:
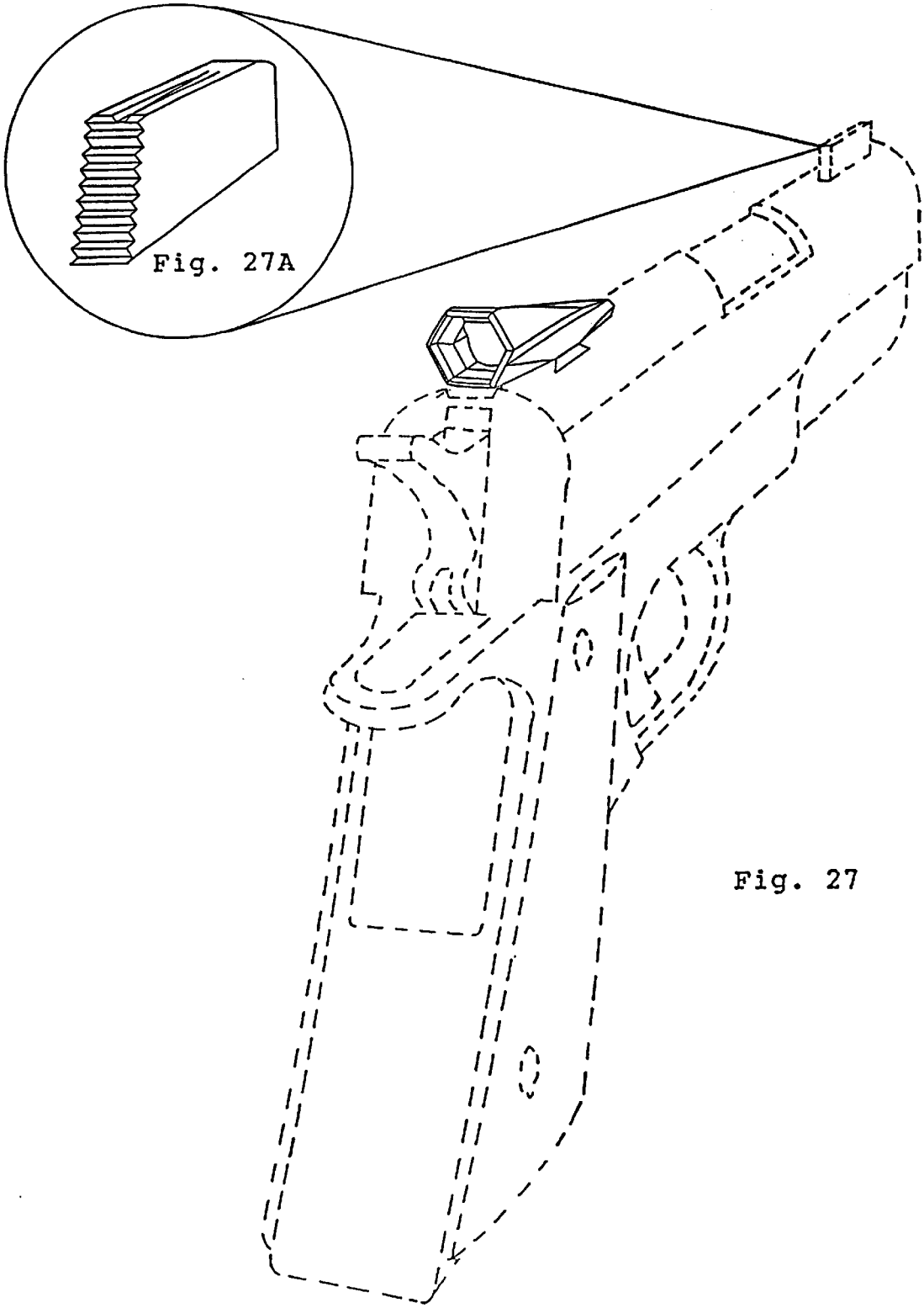
FIG. 27 illustrates an embodiment of the present invention attached to a projectile propulsion device. The projectile propulsion device is shown in broken lines.
Figure 28A:
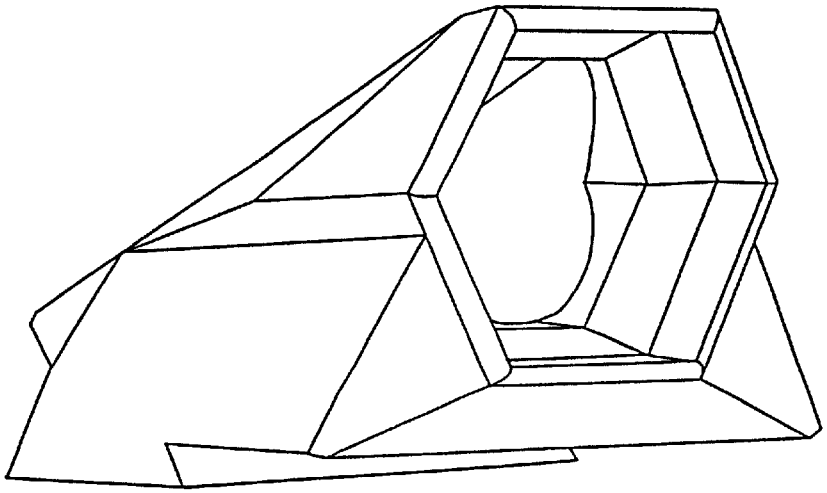
FIG. 28*a* illustrates a perspective view of a preferred embodiment of the present invention.
Figure 28B:
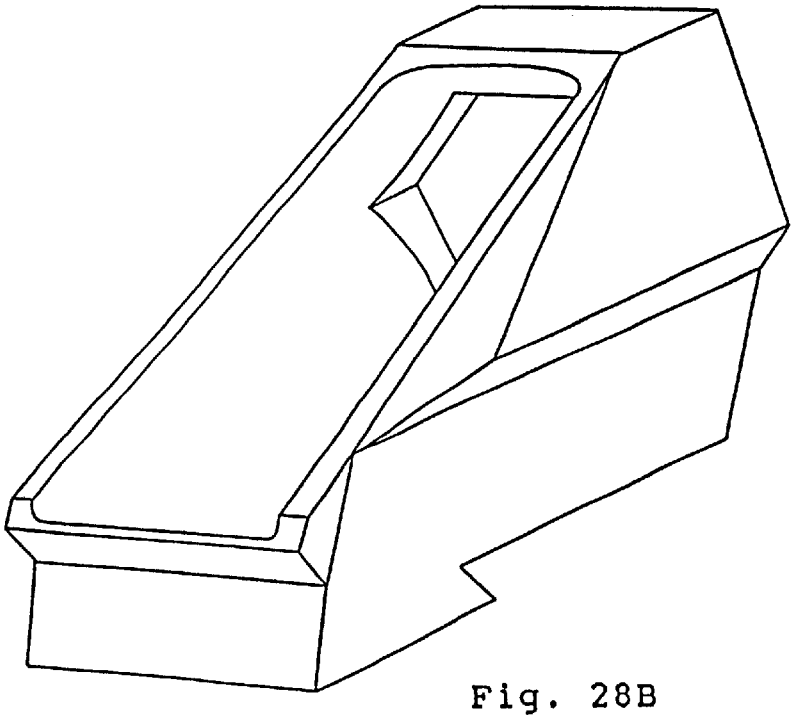
FIG. 28*b* illustrates a perspective view of a preferred embodiment of the present invention.
Figure 28C:
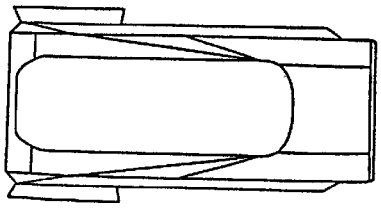
FIG. 28*c* illustrates a top view of a preferred embodiment of the present invention.
Figure 28D:
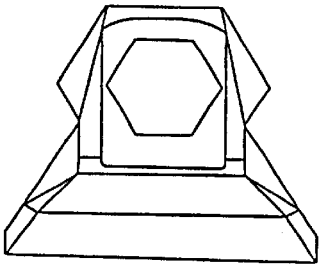
FIG. 28*d* illustrates a front view of a preferred embodiment of the present invention.
Figure 28E:
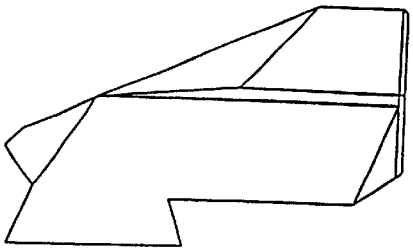
FIG. 28*e* illustrates a side view of a preferred embodiment of the present invention.
Figure 28F:
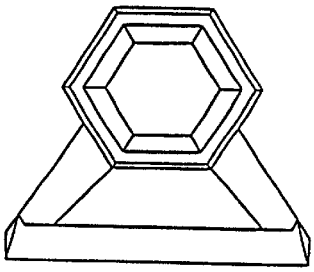
FIG. 28*f* illustrates a rear view of a preferred embodiment of the present invention.
Figure 28G:
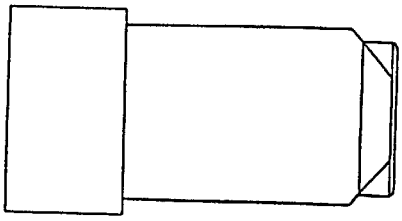
FIG. 28*g* illustrates a bottom view of a preferred embodiment of the present invention.
Figure 29:
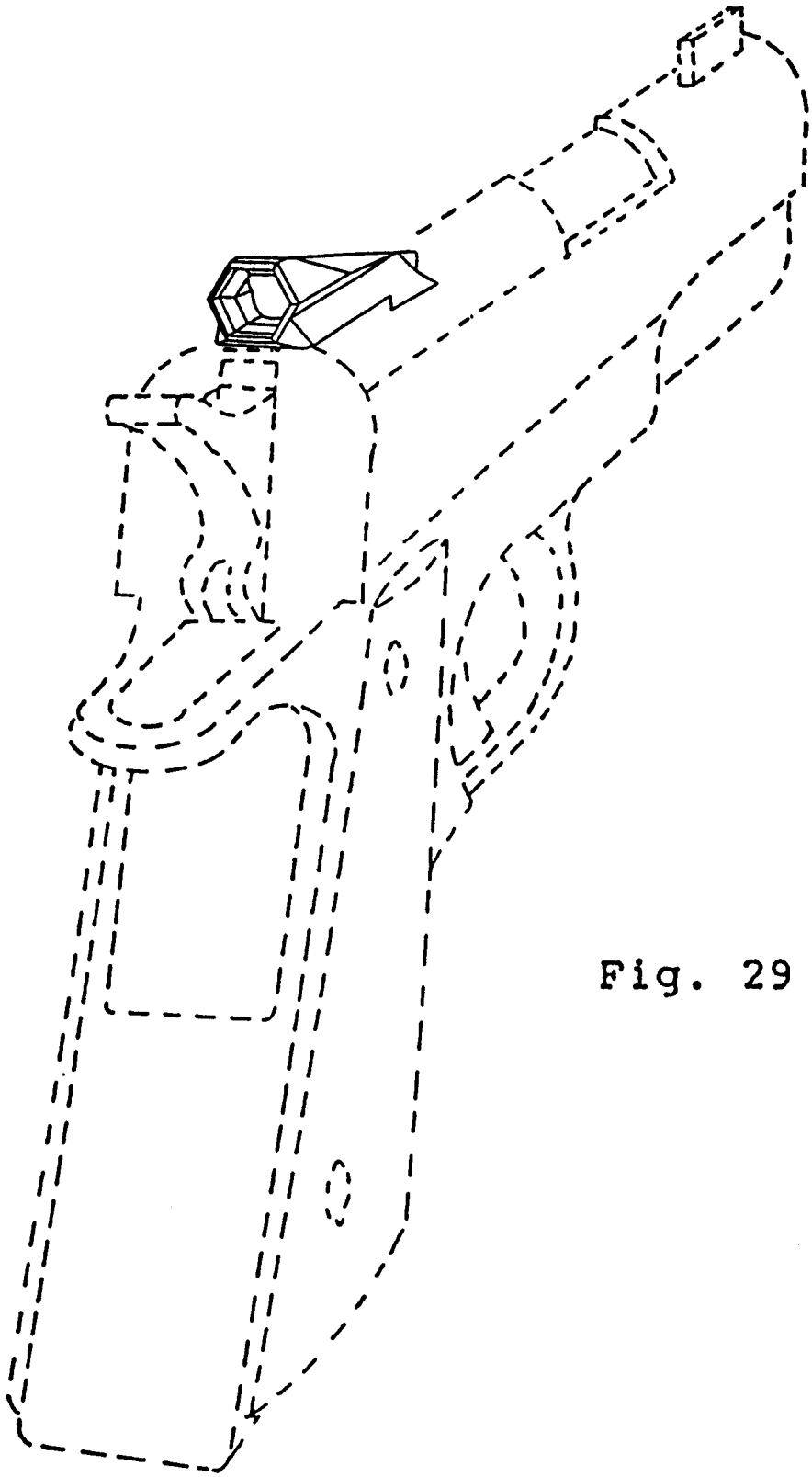
FIG. 29 illustrates an embodiment of the present invention attached to a projectile propulsion device. The projectile propulsion device is shown in broken lines.

The visual reference points at 60° and 120° on a Cartesian coordinate system (see FIG. 30, for example) are often used to visually reference the top of a vertical front sight. These visual reference points are particularly useful in assisting a user to compensate for movement of a target (see FIGS. 24–25, for example).

The preferred embodiment also has a series of visual reference points along at least a portion of the border of the solid material in which the aperture resides (see FIGS. 26A, 26C–G, 27, 28A, 28C–G, and 29). A cross-section taken through the border portion of the solid material forms the shape of a hexagon. The vertices in this series of visual reference points are positioned at 0°, 60°, 120°, 180°, 240°, and 300° on a Cartesian coordinate system (see FIG. 30, for example).

In the preferred embodiment, the visual reference points of the present invention are further enhanced with means that sharpen contrast in light and dark in the field of view of the aperture portion of the invention. These means comprise portions of the sight between the perimeter and the border that are removed to form a cavity therebetween (see FIGS. 11, 19–26A, 26F, 27, 28A, and 28F). This cavity reflects a lesser degree of light than adjacent surfaces of the invention. When viewing through the invention, the cavity appears to a user's eye as a gray-black darkened image. Often the image is out-of-focus when viewing a target, and appears as a "shadow" framing at least a portion of the aperture of the invention. Such a shadow, framing all or part of the aperture portion, enhances the light to dark contrast between the present invention and a target in the field of view of the invention. The cavity framing the aperture portion of the invention enhances the user's ability to perform rapid target acquisition and aiming adjustments, or refinements, with high accuracy.

When the visual reference points of the preferred embodiment are added together, there are a total of sixteen visual reference points on the invention. For example, the angles and vertices of the aperture portion provide six visual reference points. The angles and vertices of the cavity portion provide another six visual reference points. The hexagonal border of the aperture portion provide yet another four visual reference points. The twelve visual reference points of the cavity, or shadow, portion and the four visual reference points of the border portion are all important to the user's sighting adjustments and refinements with the present invention.

Figure 14:
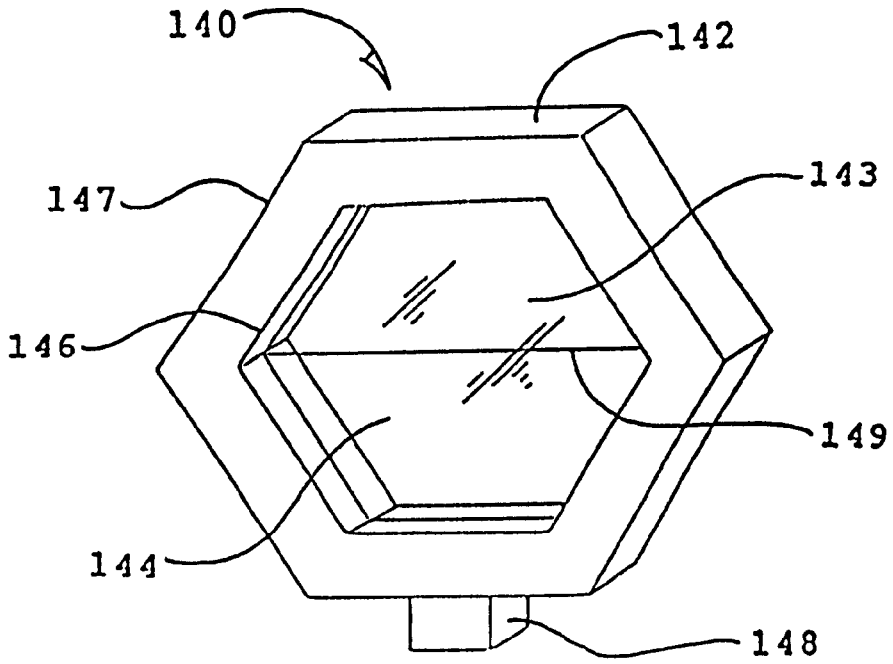
FIG. 14 illustrates an embodiment of the present invention (140), wherein material (142) defines an aperture portion (144) that has a cross-section in the shape of a polygon (146) and an outer perimeter portion in the shape of a polygon (147), and wherein transparent material (143) having a visual reference line (149) placed in a portion of the aperture portion and a base portion (148).
Figure 15:
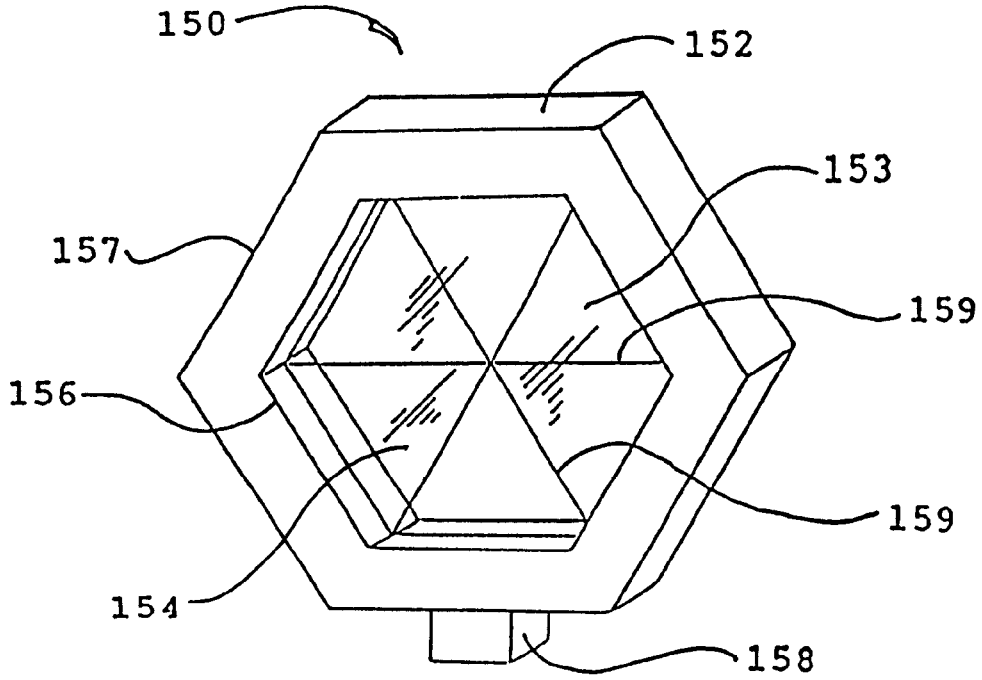
FIG. 15 illustrates an embodiment of the present invention (150), wherein material (152) defines an aperture portion (154) that has a cross-section in the shape of a polygon (156) and an outer perimeter portion in the shape of a polygon (157), and wherein transparent material (153) having a plurality of visual reference lines (159) placed in portions of the aperture portion and a base portion (158).
Figure 15A:
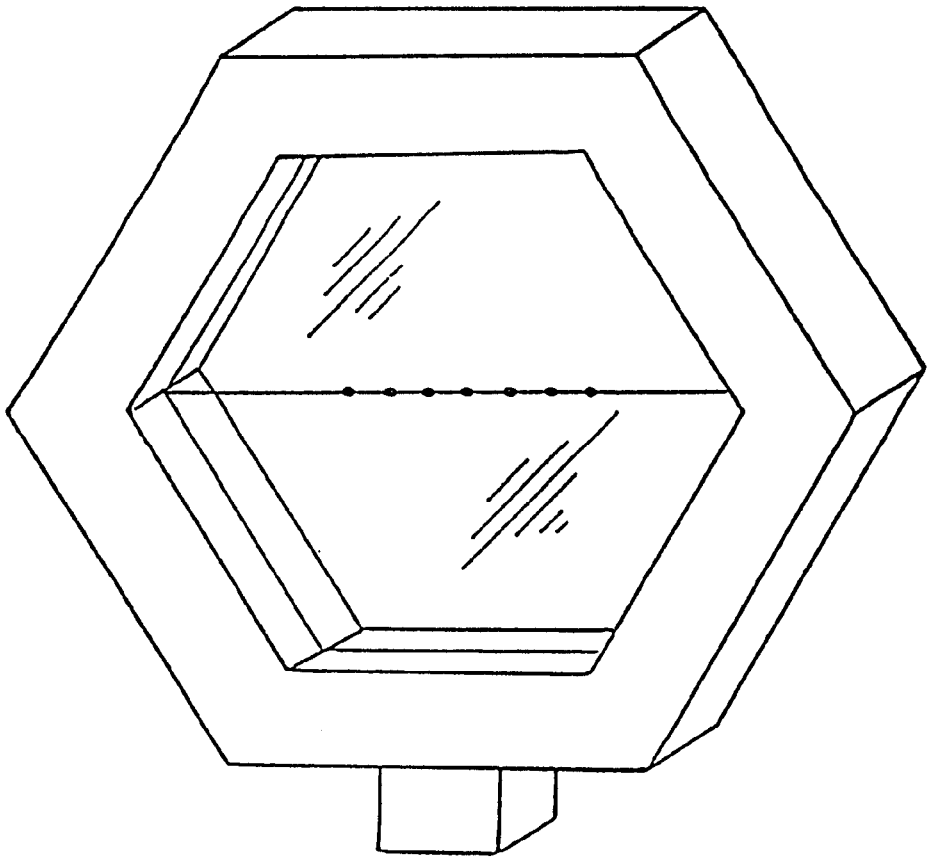
FIG. 15*a* illustrates the embodiment of FIG. 15 with additional reference points in the aperture portion of the device in the form of Mil Dots.
Figure 16:
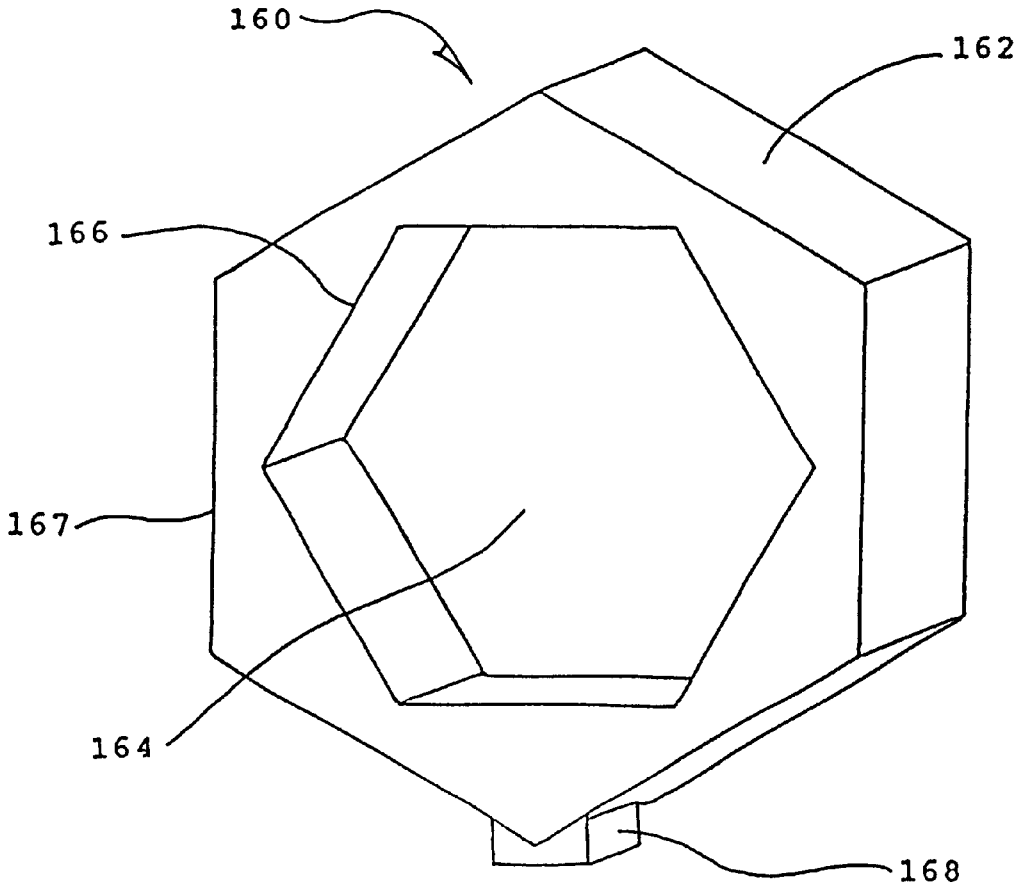
FIG. 16 illustrates an embodiment of the present invention (160), wherein material (162) defines an aperture portion (164) that has a cross-section in the shape of a first polygon (166) and an outer perimeter portion in the shape of a second polygon (167), and wherein the first polygon is different from the second polygon and a base portion (168).
Figure 18A:
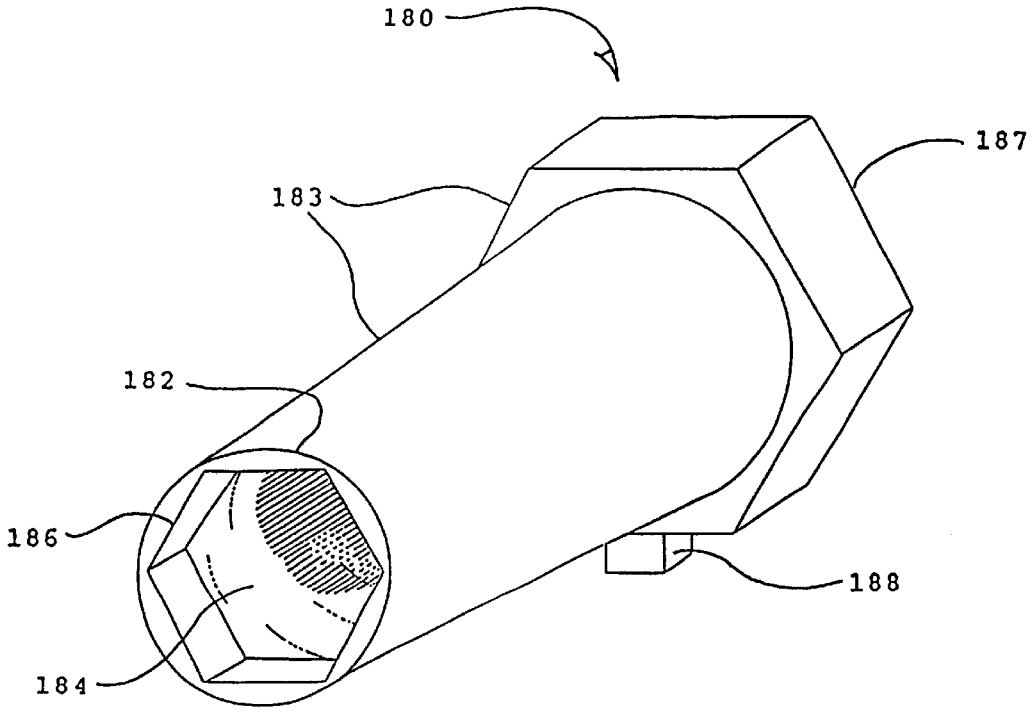
FIG. 18*a* illustrates an embodiment of the present invention (180), wherein material (182) defines an aperture portion (184) having an outer perimeter in the shape of a polygon (186) and additional material (183) that defines a remaining portion, wherein the remaining portion has an increasing inner diameter along the length of the portion, and wherein at least part of the remaining portion has an outer perimeter in the shape of a polygon (187) and a base portion (188).

Additional visual reference points can be placed in and around the aperture portion of the present invention. For example, a transparent material can be placed in at least a portion of the aperture such that an edge of the material connects two or more of the vertices of the polygonal shaped perimeter. The edge of the material in the aperture portion is easily seen by the user's eye and serves as a visual reference point. Alternatively, one or more lines can be drawn upon or incorporated into the transparent material in the aperture portion of the present invention (see FIGS. 14 and 15, for example). In addition, other visual reference points that can be placed in the aperture portion include means such as Mil Dots, modified Mil Dots, and similar range-finding reference points, lines, or bars. These visual reference points within the aperture portion of the present invention can be mechanically applied or electronically generated.

The transparent material can be made of any glassy or polymeric material that is suited to withstand the mechanical stresses imposed on the material by the particular projectile propulsion device being used with the present invention.

In addition, other vision enhancing features can be included in the present invention. These features include, but are not limited to, magnifying lenses, tinted transparent materials for the aperture, and so-called "night-vision" electronic equipment.

Sighting aids of the present invention are usually affixed to, or integrated with, an implement requiring visual alignment. In use, a polygon-shaped aperture sight of the present invention is used as a rear sight in combination with a vertical front sight comprised of a blade, post, or the like. Preferably, the vertical front sight has a hemispherical groove cut along the top (see FIGS. 19–25). More preferably, the vertical front sight has a hemis-hexagon cut along the top of the sight so as to present a user with a cross-sectional view of a partial hexagon (see FIG. 27A). The combination of a rear polygonal aperture sight with either of these preferred front sights comprises a sighting system of the present invention (see FIGS. 19–25, 27A, and 28).

The base portion of the present invention can be any shape that permits reasonably firm and resilient attachment of the invention to a projectile propulsion device or other implement requiring aiming at a target. With many firearms, for example, a portion of the firearm, commonly referred to as a 60-degree "standard dove-notch" or as a 65-degree "deep dove-notch," is manufactured into the firearm to receive a sight having a mated base portion. The present invention is readily adapted to have a base portion that conforms to these types of sight-receiving notches.

Other methods of attaching the present invention to a suitable implement include, bolting in place, friction fitting, welding, brazing, or formed as part of the implement. Alternatively, a second base portion can be employed that allows for additional adjustments of the present invention for elevation, windage, thermal influences, movement of the target, and the like.

Material of the present invention delimiting the aperture can optionally be modified to enhance the light and dark contrast between the material of the invention and the field of view seen through the aperture. Such visual accentuation can be done by visually lightening the material with a light colored or luminous paint, for example. The material can be darkened with a paint, as well. Surface modifications can also be employed to visually accent or darken a surface of the present invention. The surface can be roughened, etched, oxidized, and/or polished, for example.

In another embodiment of the present invention, the material in which the aperture is made is in the form of a hollowed prism (see FIGS. 4A, 6A, and 11–15A). A prism is a polyhedron comprised of at least five polygon shaped faces. Two of the faces are substantially parallel and substantially congruent. Each of these faces is referred to as a base. The bases are connected together in the polyhedron by lateral faces. Each lateral face is in the shape of a parallelogram. The lateral faces are formed by connecting pairs of corresponding vertices of the base polygons. The lateral faces are all substantially congruent. A cross-section taken through the lateral faces, substantially parallel to the bases, has an outer perimeter that is substantially in the form of a polygon. In this embodiment, a portion of the material of the sighting aid is removed, or hollowed out, from the prism-shaped material to form a polygon-shaped aperture portion.

In other embodiments of the present invention, only a portion of the sighting aid is in the form of a hollow prism. The remaining portions of these embodiments can be of any cross-sectional shape as long as the polygon-shaped cross-section of the aperture is not obscured from the user when using the present invention. Preferably, these remaining portions are cylindrical in shape. Alternatively, these remaining portions are substantially conical in shape. In addition, these remaining portions can have a polygonal cross-sectional shape (see FIGS. 5A, 7A, 8A, 9A, 10A, and 18A).

The dimensions of the aperture portion of the present invention depend largely on the particular projectile propulsion device being used with the invention. For hand-held firearms, for example, the aperture portion preferably has an inner diameter of about 0.15 inches to about 1.0 inches, more preferably 0.20 inches to about 0.50 inches, most preferably 0.225 inches to about 0.350 inches. The cavity portion surrounding the aperture has an outer diameter preferably about 0.025 inches to about 0.150 inches larger than the inner diameter of the aperture, more preferably 0.100 inches larger. Dimensions of the present invention for use with larger projectile propulsion devices can be readily determined.

The present invention can be constructed of any suitable material that will withstand the rigors of a particular application. These materials include, but are not limited to, metals, metallic alloys, polymeric materials, including plastics, ceramics, and elastomeric materials, either alone or in combination. Hardened metals are preferred for sighting aids used with firearms, tear-gas launchers, and rubber-bullet guns, for example. In addition to metals, metal alloys, and polymeric materials, composites material are useful for making sighting aids that are used with small firearms, cross-bow, and bow and arrow, for example.

Preferably the sighting aids of the present invention are constructed of a high-quality steel or steel alloy. The steel is machined from raw dimensional steel stock. Alternatively, the invention is cast or hot forged in one or more suitable materials.

Erosion Discharge Machining (EDM) is a preferred machining process. In addition to readily forming the polygonal aperture portion of the present invention, EDM is particularly suited to form the concavity portion of the invention.

In many embodiments of the present invention, various combinations of these and other methods may be required to produce a particular embodiment.

The present invention can be made in various ways. A preferred way of making a rear aperture sight of the present invention is in two main steps. The first step performs cuts to a block of solid material to establish the general exterior shape of the sight. The second step forms the aperture portion and the optional cavity. These steps can be made by standard machining techniques, including computer numeric control (CNC) machining, water-jet cutting, for example.

The preferred method of obtaining the general exterior shape of the sight in a solid metal material is water-jet cutting. For example, a block of suitable metal, such as cold-rolled steel barstock, is securely attached to a solid tooling fixture. Desired exterior dimensions are programmed into a computer controlling the waterjet cutting apparatus. The program is executed and the computer-controlled water-jet cutting apparatus performs the desired cuts.

Once the various cuts are made to the exterior surfaces of the solid metal, the aperture portion of the rear sight is formed. Various methods are suitable for making the aperture portion of the sight, including, but not limited to, broach cutting, water-jet cutting, and electric discharge machining (EDM). The optional cavity surrounding the aperture portion is preferably formed with EDM. All surfaces are final-finished with a horizonal grinder, EDM, or CNC machining.

Preferably, a matt-black finish is applied to the sight. The matt-surface is obtained by high-pressure aggregate texturing. A hot dipped oxide process is effected to obtain a black finish. Alternatively, a polymer coating or chemical staining process, such as chrome sulfide finishing, can be used to form a matt finish on the surfaces of the invention. In addition, nitride-based finishes, such as those employing titanium nitride, can be used.

Alternatively, a rear aperture sight of the present invention can be made by molding. Suitable molding techniques include, but are not limited to, machine injection molding, investment casting, or injection molding.

The visual reference points of a vertical front sight of the present invention are made by cutting portions of the top of the vertical front sight with conventional machining techniques, including, but not limited to, broach cutting and electric discharge machining (EDM).

What is claimed is:

1. A sighting system for placement on a device that propels projectiles, said system comprising:

a front sight comprising a first solid material, said material having a blade portion attached to a base portion, wherein said base portion is adapted to be mounted on said projectile propulsion device;

a rear aperture sight comprising a second solid material having a single hole therein through which a field of view can be seen by a user, wherein said hole is comprised of a center point and a perimeter, wherein said perimeter of said hole is substantially in the shape of a hexagon comprised of at least six sides that each converge at a vertex, wherein one or more of said vertices is adapted to serve as a visual reference point in said rear aperture sight for use in conjunction with said front sight to aim a projectile propulsion device at a target, and wherein said second solid material further comprises a portion apart from said aperture that is adapted to attach to said projectile propulsion device.

2. The sighting system of claim 1 wherein said hexagonally shaped aperture is oriented in the rear sight such that, when said rear sight is in use, two of the six vertices of said hexagonally shaped hole appear to a user to be positioned at a three o'clock position and a nine o'clock position, respectively, relative to the center point of the hexagonally shaped aperture.

3. The sighting system of claim 1 wherein said second solid material further comprises a border around said material defining said hole, said border having a cross-sectional shape of a hexagon, said hexagon shape comprising a series of straight edges with ends thereof connected to form a series of verticies, wherein said straight edges and vertices are adapted to serve as visual reference points along said border, wherein said visual reference points assist a user to visually align said front sight with a target.

4. The sighting system of claim 3 wherein portions of said second solid material between said perimeter and said border of said rear aperture sight are removed to form a cavity in said second solid material.

5. The sighting system of claim 4 wherein solid material between said border and said cavity is rounded.

6. The sight system of claim 1 wherein said projectile propulsion device is a firearm.

7. The sight system of claim 1 wherein said second solid material is metal.

8. The sight system of claim 1 wherein said second solid material is polymeric.

9. The sight system of claim 1 wherein said first solid material is metal.

10. The sight system of claim 1 wherein said first solid material is polymeric.

11. A sighting system for placement on a device that propels projectiles, said system comprising:

a front sight comprising a first solid material, said first solid material having a vertically oriented elemented adapted to be mounted on said projectile propulsion device;

a rear aperture sight comprising a second solid material having a single hole therein through which a field of view can be seen by a user, wherein said hole is comprised of a center point and a perimeter, wherein said perimeter of said hole is substantially in the shape of a hexagon comprised of at least six sides that each converge at a vertex, wherein one or more of said vertices is adapted to serve as a visual reference point in said rear aperture sight for use in conjuction with said front sight to aim a projectile propulsion device at a target, and wherein said second solid material further comprises a portion a portion apart from said aperture that is adapted to join said rear aperture sight to said projectile prpoulsion device.

12. The sighting system of claim 11 wherein said hexagonally shaped aperture is oriented in the rear sight such that, when said rear sight is in use, two of the six vertices of said hexagonally shaped hole appear to user to be positioned at a three o'clock position and a nine o'clock position, respectively, relative to the center point of the hexagonally shaped aperture.

13. The sighting system of claim 11 wherein said second solid material further comprises a border around said material defining said hole, said border having a cross-sectional shape of a hexagon, said hexagon shape comprising a series of straight edges and vertices are adapted to serve as a visual reference points along said border, wherein said visual reference points assist a user to visually align said front sight with a target.

14. The sighting system of the claim 14 wherein solid material between said perimeter and said border of said rear aperture sight are removed to form a cavity in said second solid material.

15. The sighting system of claim 14 wherein solid material between said border and said cavity is rounded.

16. The sighting system of claim 11 wherein said vertically oriented is in the form of a blade.

17. The sighting system of claim 11 wherein said vertically oriented element is in the form of a post.

18. The sighting system of claim 11 wherein said second solid material is metal.

19. The sighting system of claim 11 wherein said second solid material is polymeric.

20. The sighting system of claim 11 wherein said projectile propulsion device is a firearm.

21. A sighting system on device that propels projectiles, said system comprising:

a front sight comprising a first solid material, said first solid material having a vertically oriented element mounted on said projectile propulsion device;

a rear aperture sight comprising a second solid material having a single hole therein through which a field of view can be seen by a user, wherein said hole is comprised of a center point and a perimeter, wherein said perimeter of said hole is comprised of a center hexagon comprised of at least six sides that each converge at a vertex, wherein one or more of said vertices is adapted to serve as a visual reference point in said rear aperture sight for use in conjunction with said front sight to aim a projectile propulsion device at a target, and wherein said second solid material further comprises a portion apart from said aperture that is adapted to join said rear aperture sight to said projectile propulsion device.

22. The sighting system of claim 21 wherein said hexagonally shaped aperture is oriented in the rear sight such that, when said rear sight is in use, two of the six vertices of said hexagonally shaped hole appear to a user to be positioned at a three o'clock position and a nine o'clock position, respectively, relative to the center point of the hexagonally shaped aperture.

23. The sighting system of claim 21 wherein said second solid material further comprises a border around said material defining said hole, said border having a cross-sectional shape of a hexagon, said hexagon shape comprising a series of straight edges with ends thereof connected to form a series of verticies, wherein said straight and vertices are adapted to serve as visual reference points along said border, wherein said visual reference points assist a user to visually align said front sight with a target.

24. The sighting system of claim 23 wherein portions of said second solid material between said perimeter and said border of said rear aperture sight are removed to form a cavity in said second solid material.

25. The sighting system of claim 24 wherein solid material between said border and said cavity is rounded.

26. The sighting system of claim 21 wherein said vertically oriented element is in the form of a blade.

27. The sighting system of 21 wherein said vertically oriented element is in the form a post.

28. The sighting system of claim 21 wherein said second solid material is metal.

29. The sighting system of claim 21 wherein said second solid material is polymeric.

30. The sighting system of claim 21 wherein said projectile propulsion device is a firearm.

* * * * *